United States Patent [19]

Kauffman et al.

[11] 4,244,281

[45] Jan. 13, 1981

[54] CARTON, FEEDER APPARATUS FOR PACKAGING MACHINES

[75] Inventors: Ivan L. Kauffman, Commerce Township, Oakland County; Robert J. Allen, Farmington; Gregory J. Dwyer, Livonia, all of Mich.

[73] Assignee: Ex-Cell-O Corporation, Troy, Mich.

[21] Appl. No.: 4,931

[22] Filed: Jan. 19, 1979

[51] Int. Cl.[3] ..... B31B 1/80

[52] U.S. Cl. ..... 493/123; 53/565; 493/164

[58] Field of Search ..... 93/44.1 R, 44.1 GT, 93/53 SD, 44; 53/565, 564

[56] References Cited

U.S. PATENT DOCUMENTS

| | | | |
|---|---|---|---|
| 2,900,880 | 8/1959 | Engleson et al. | 93/53 SD |
| 3,408,906 | 11/1968 | Heffelfinger et al. | 93/44.1 R |
| 3,486,423 | 12/1969 | Mistarz | 93/53 SD |
| 3,991,660 | 11/1976 | Calvert et al. | 93/53 SD |

*Primary Examiner*—James F. Coan

*Attorney, Agent, or Firm*—John P. Moran

[57] ABSTRACT

A carton magazine apparatus, carton feeder apparatus and carton loader apparatus for feeding and loading erected cartons, in pairs, on a pair of mandrels for forming the bottom end of the cartons. The carton magazine apparatus includes a pair of carton magazines disposed in side-by-side, spaced apart positions, with each of the carton magazines containing a plurality of flattened cartons. The carton feeder apparatus includes a pair of swingably mounted carton feeder arms, with one of the carton feeder arms being operatively disposed adjacent the carton discharge end of one of the magazines and the other carton feeder arm being operatively disposed adjacent the carton discharge end of the other magazine. The pair of carton feeder arms are operable to simultaneously withdraw a flattened carton from each of the carton magazines and move them into an erected tubular position in alignment with a pair of mandrels on a packaging machine. The carton loader apparatus includes a pair of carton loader hooks and carton guide means for moving the pair of erected tubular cartons upwardly onto the two mandrels on the packaging machine. Power drive means is provided for operating the carton feeder apparatus and the carton loader apparatus.

9 Claims, 29 Drawing Figures

CARTON, FEEDER APPARATUS FOR PACKAGING MACHINES

TECHNICAL FIELD

This invention relates generally to the packaging machine art, and more particularly, to a carton magazine, feeder and loader apparatus for packaging machines. The invention is specifically concerned with a carton magazine, feeder and loader apparatus for simultaneously erecting a pair of tubular cartons, and then simultaneously loading them onto a pair of bottom end forming mandrels on a rotary turret which indexes the cartons through a bottom end forming series of operations, after which the bottom formed cartons are stripped from the mandrels, in pairs, and then indexed through various work stations to accomplish filling and sealing of the cartons.

BACKGROUND ART

It is known in the packaging art to provide carton magazines which hold a plurality of flat cartons. It is also known to provide carton feeder means and carton loader means for withdrawing flattening cartons from a carton magazine and erecting them and loading them onto mandrels for forming the bottom ends of cartons. Examples of prior art carton magazines, carton feeder apparatuses, and carton loader apparatuses are shown in U.S. Pat. Nos. 3,002,328; 3,212,413; and 3,331,186. A disadvantage of the prior art carton magazines, carton feeder apparatuses and carton loading apparatuses is that they cannot be used on a fast operating packaging machine which indexes at least a pair of cartons in each operative step of forming, filling and closing the cartons during a packaging operation. A further disadvantage of the prior art carton magazines is that they are adapted for only certain types of machines and cannot be changed from one type of machine to another without extensive changes as, for example, they cannot be modified easily to be used on either a right hand or a left hand packaging machine.

DISCLOSURE OF THE INVENTION

This invention relates to the carton or container packaging art, and to carton magazine, carton feeder and carton loader apparatuses for use in a packaging machine for forming, filling and closing cartons, and wherein said indexing packaging machine includes at least two carton mandrels for forming the bottom ends of cartons, after which they are indexed through various work stations to accomplish filling and sealing of the cartons.

The carton magazine apparatus includes a pair of carton magazines which are disposed in a parallel, side-by-side relationship, in spaced apart positions, and with each of the carton magazines containing a plurality of flattened cartons. Each of the carton magazines has a rear end and a carton discharge front end. Each carton magazine includes an elongated carton support means for slidably supporting the flattened cartons, a carton pusher means movably mounted over the carton support means, and carton guide means operatively mounted along each side of the carton support means. The carton guide means are interchangeable, from side-to-side, so that the carton magazines can be easily converted for use with either a right hand or a left hand packaging machine. Each of the carton magazines includes releasable retainer means on the front discharge end for releasing the cartons as they are individually removed by the carton feeder apparatus. Each of the carton magazines is provided with a means for maintaining a forward bias on the carton pusher means so as to continuously feed the flattened cartons forwardly as the frontmost carton is removed from each magazine. A releasable latch means is operatively mounted at the rear end of each of the carton magazines for releasably holding the carton pusher means in a retracted position at the rear end of the magazine while an additional supply of flattened cartons is loaded into the magazine.

The carton feeder means comprises a pair of swingably mounted carrier members which are each fixedly secured to a pivot shaft disposed adjacent one of the discharge front ends of the carton magazines. A vacuum cup means is operatively mounted on each of the carrier members. A power drive means is operatively connected to the carton feeder arm pivot shafts for rotating the shafts and the carrier members, between a first position at which the vacuum cups withdraw a flattened carton from the adjacent carton magazine, and a second position at which the withdrawn carton is expanded and erected into a squared condition. Each of the carton feeder arms is provided with a bowing flange means for engagement with a carton as it is withdrawn from a carton magazine to assist in the expansion and erection of the carton into an erected tubular carton. The carton feeder arms move the two erected tubular cartons into a position below and in alignment with a pair of carton bottom end forming mandrels on the packaging machine as, for example, a pair of mandrels on an indexing rotary turret.

The carton loader apparatus includes a pair of hook members which are swingably mounted on a mounting bracket means which is carried on the top of a vertically movable lift rod. The hook members engage the pair of erected tubular cartons and move them upwardly through suitable guide members onto the aligned mandrels on the packaging machine. A guide rod is provided for guiding the vertical movement of the pair of hooks between a lowered inoperative position, and a raised position at which the hook members have loaded the pair of cartons on the pair of mandrels. A power drive means is provided for operating the carton loader apparatus, and it includes a lift lever for moving the lift rod and the hook members between the lower inoperative position and the raised position, and a lever actuating means operated by the drive means of the packaging machine.

BRIEF DESCRIPTION OF THE DRAWINGS

FIGS. 1C and 1D are enlarged, fragmentary, plan views of the outer carton blank magazine shown in FIG. 1, and showing fragmentary portions of the same view of the outer carton blank magazine structure, drawn to an enlarged scale.

BEST MODE OF CARRYING OUT THE INVENTION

Figure 1:
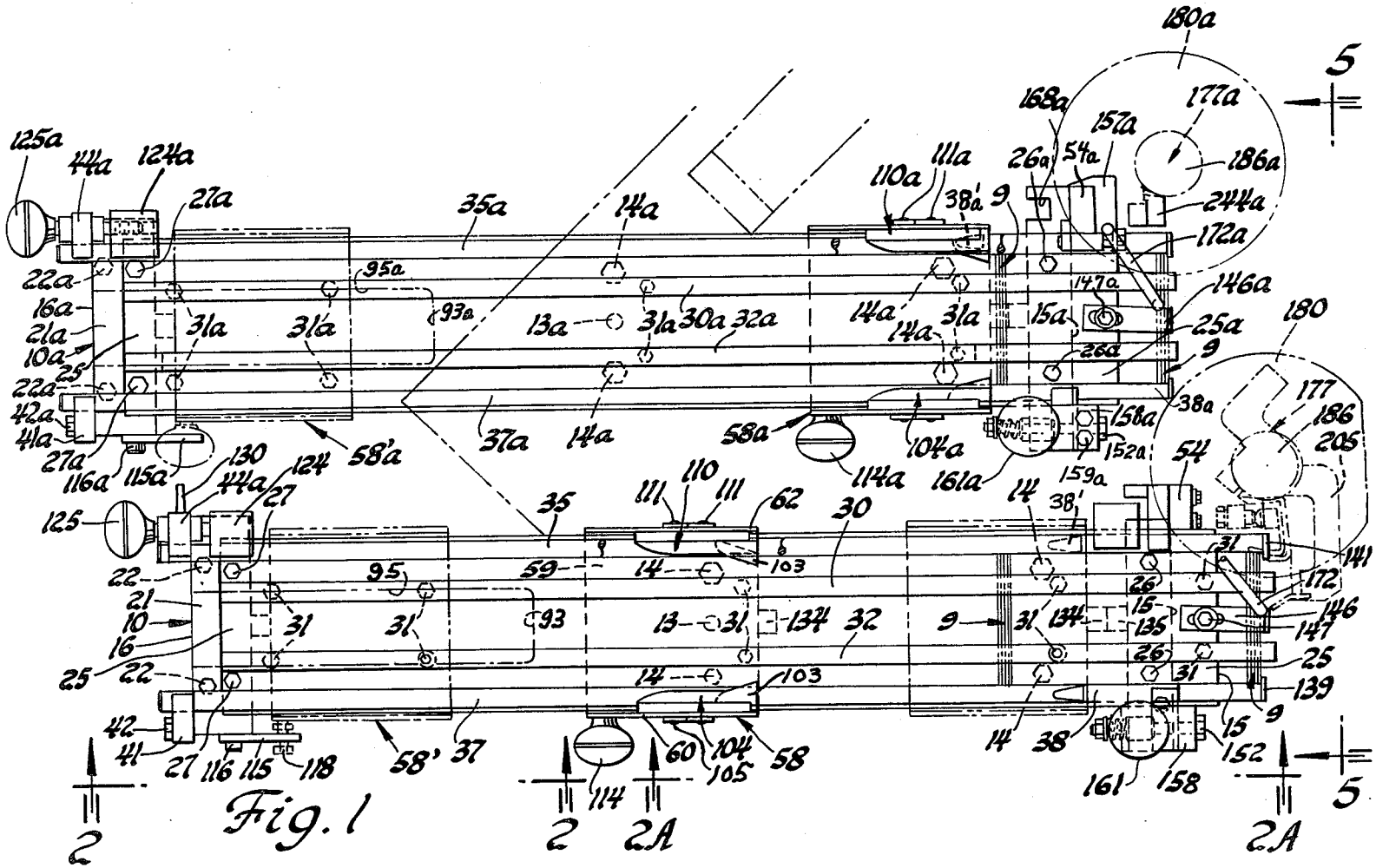
FIG. 1 is a top plan view of a pair of carton blank magazines made in accordance with the principles of the present invention.
Figure 1A:
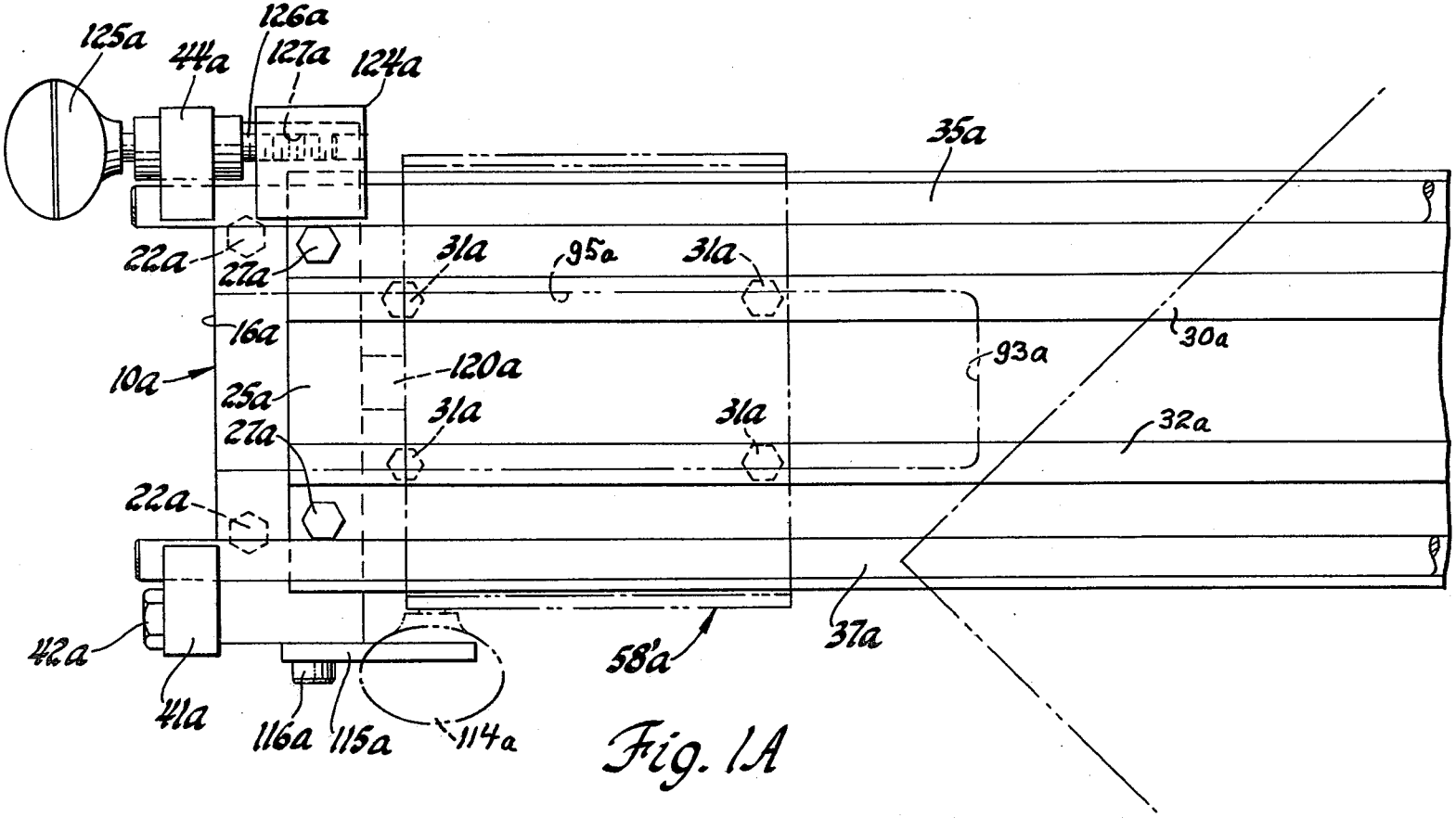
FIGS. 1A and 1B are enlarged, fragmentary, plan views of the inner carton blank magazine shown in FIG. 1, and showing fragmentary portions of the same view of the inner carton blank magazine structure drawn to an enlarged scale.
Figure 1B:
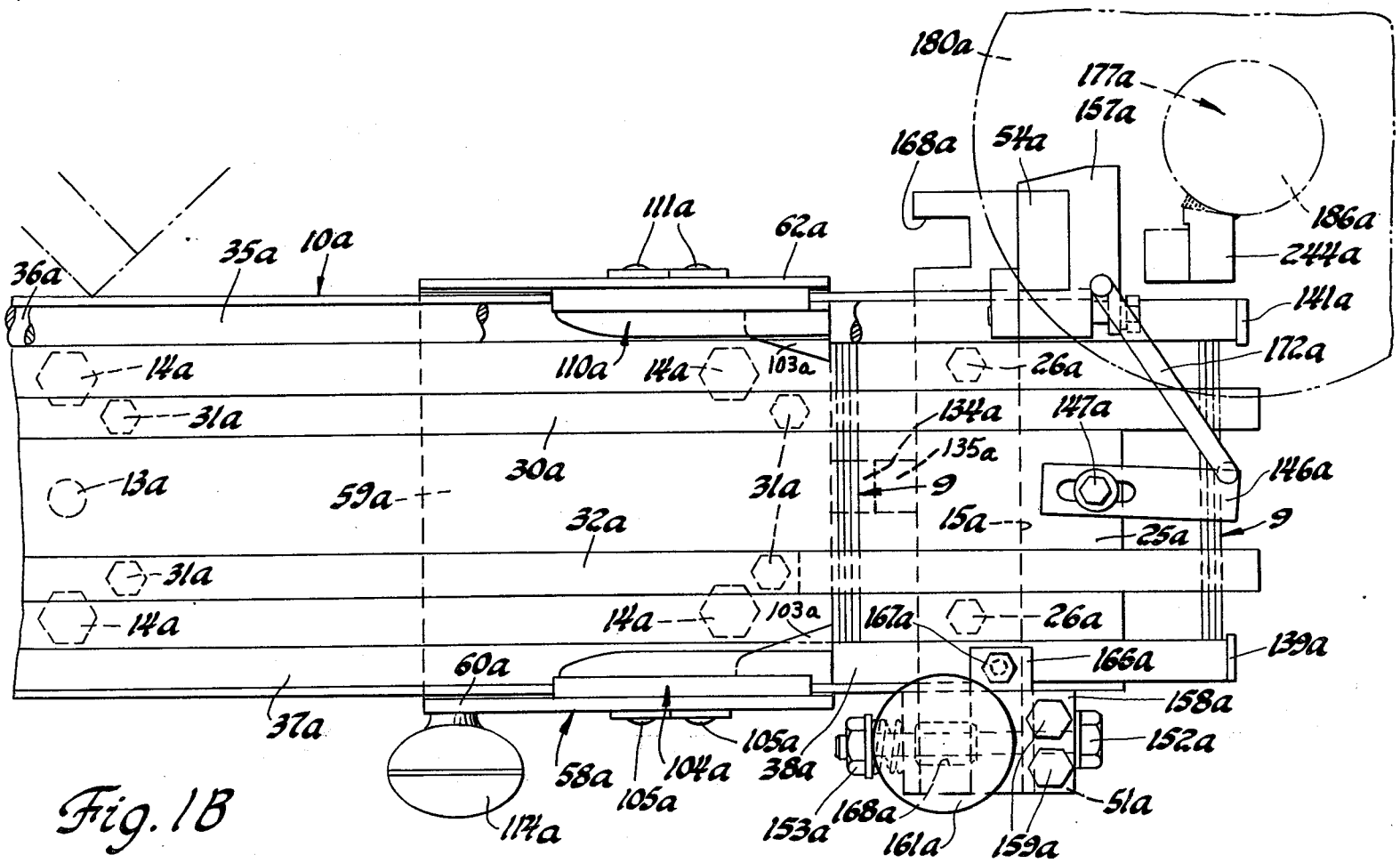

Referring now to the drawings, and in particular to FIG. 1, the numerals 10 and **10*a* each generally designate a carton magazine made in accordance with the principles of the present invention. The magazine designated by the numeral 10 in FIG. 1 may be called the "outer magazine" and the magazine designated by the numeral 10*a* may be called the "inner magazine". It will be seen that the two magazines 10 and 10*a* are disposed parallel to each other, in a longitudinally offset relationship, and they are adapted to have cartons 9 withdrawn by a pair of carton feeder means for loading the cartons 9 onto suitable mandrels on a carton forming, filling and closing machine. The reference numerals used hereinafter to describe the outer magazine 10 have also been used to designate the same parts on the inner magazine 10*a***, followed by the small letter "a".

Figure 1C:
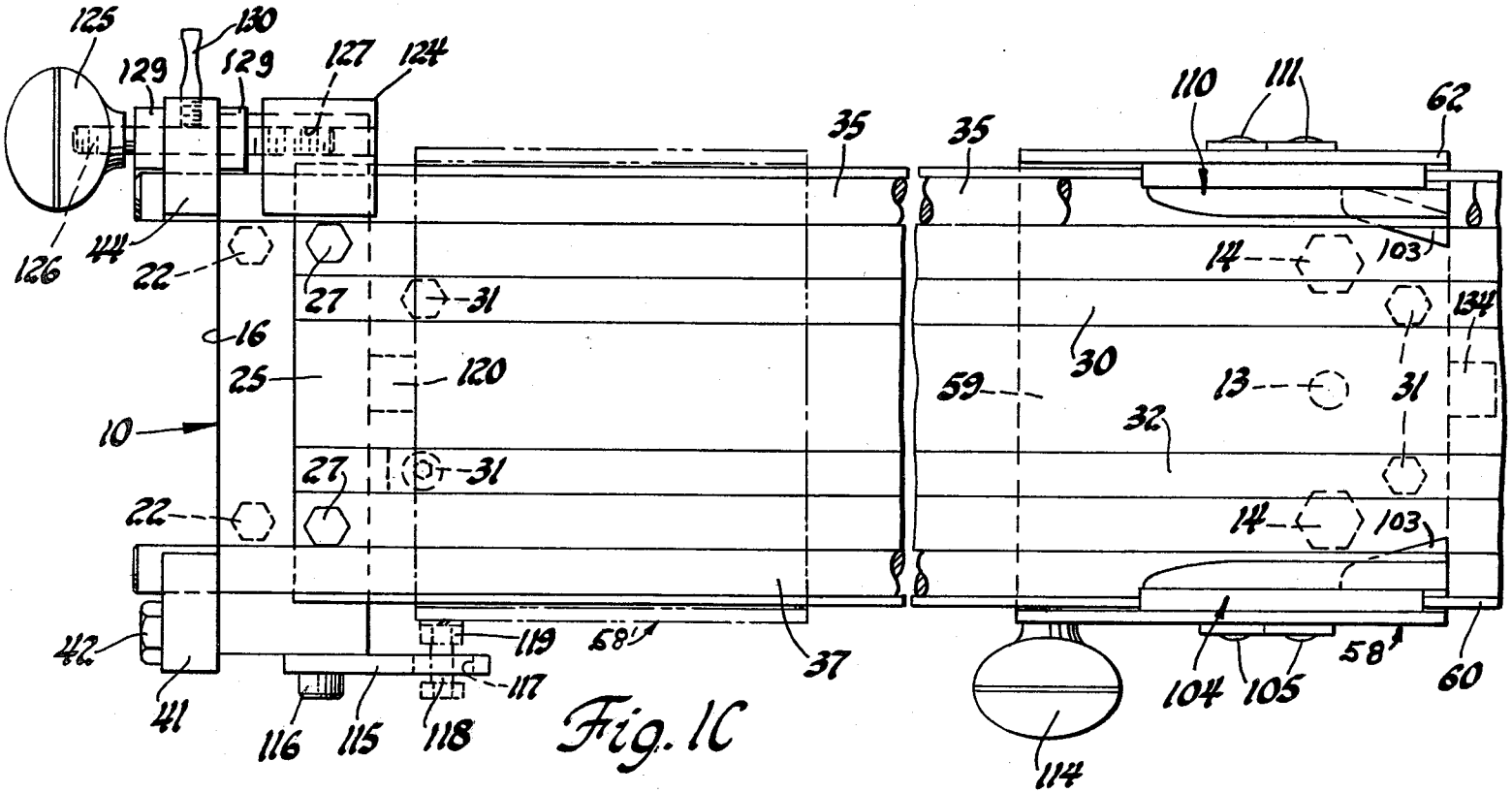
Figure 2:
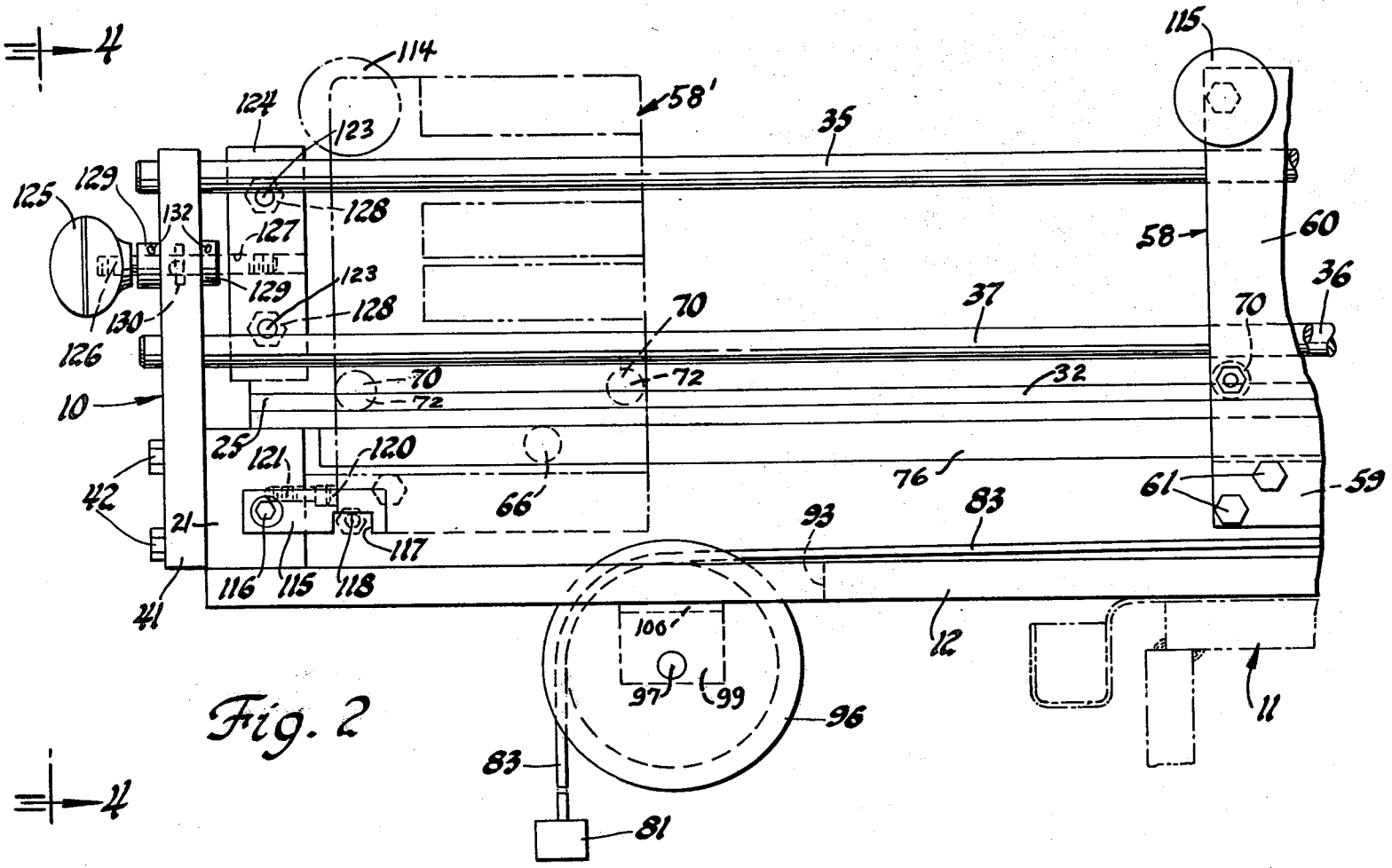
FIG. 2 is a fragmentary, enlarged, front elevation view of the left end of the outer carton blank magazine structure illustrated in FIG. 1, taken along the line 2—2 thereof, and looking in the direction of the arrows.
Figure 2A:
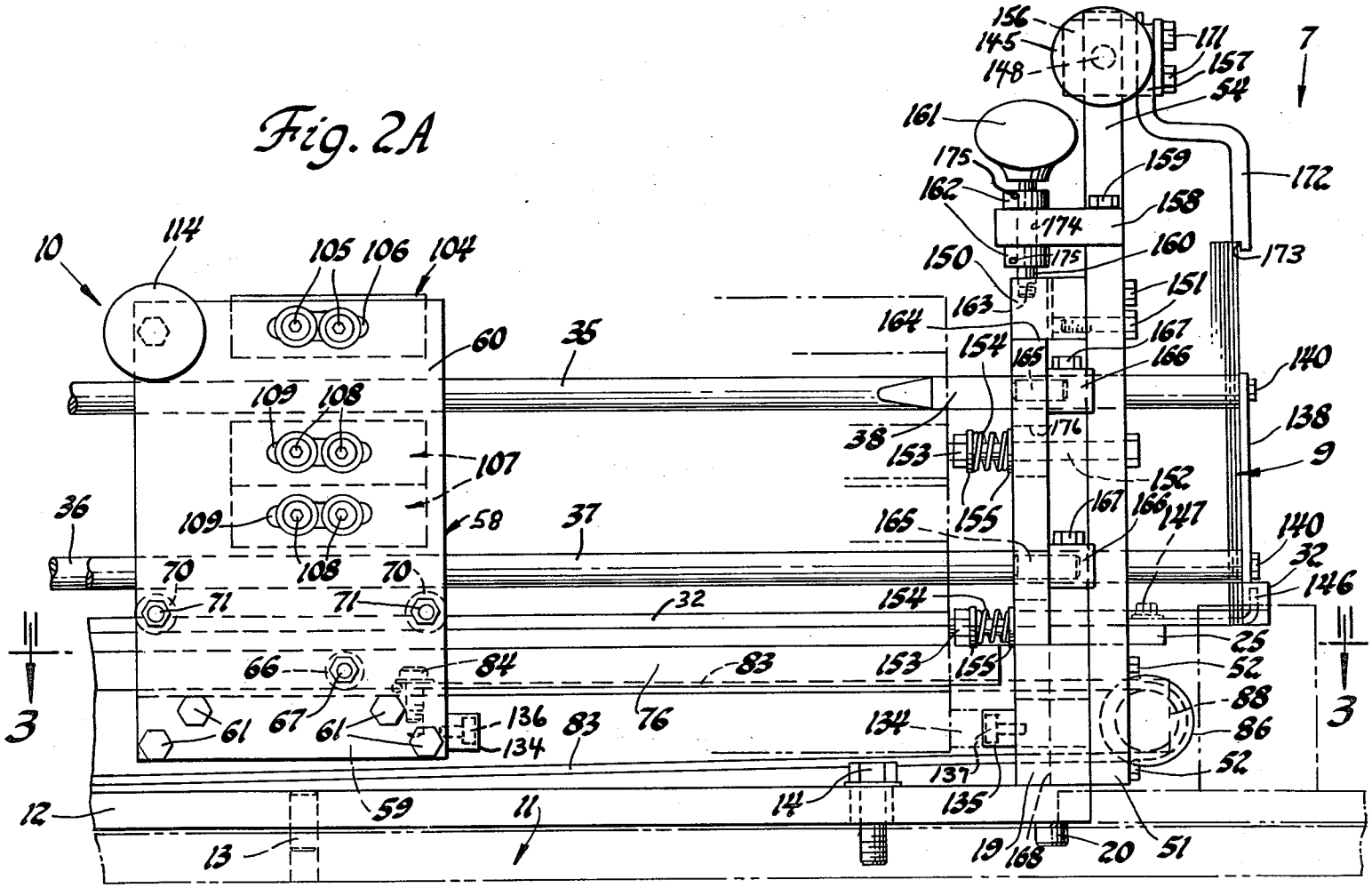
FIG. 2A is a fragmentary, enlarged, front elevation view of the right end of the outer carton blank magazine illustrated in FIG. 1, taken along the line 2A—2A thereof, and looking in the direction of the arrows.
Figure 5:
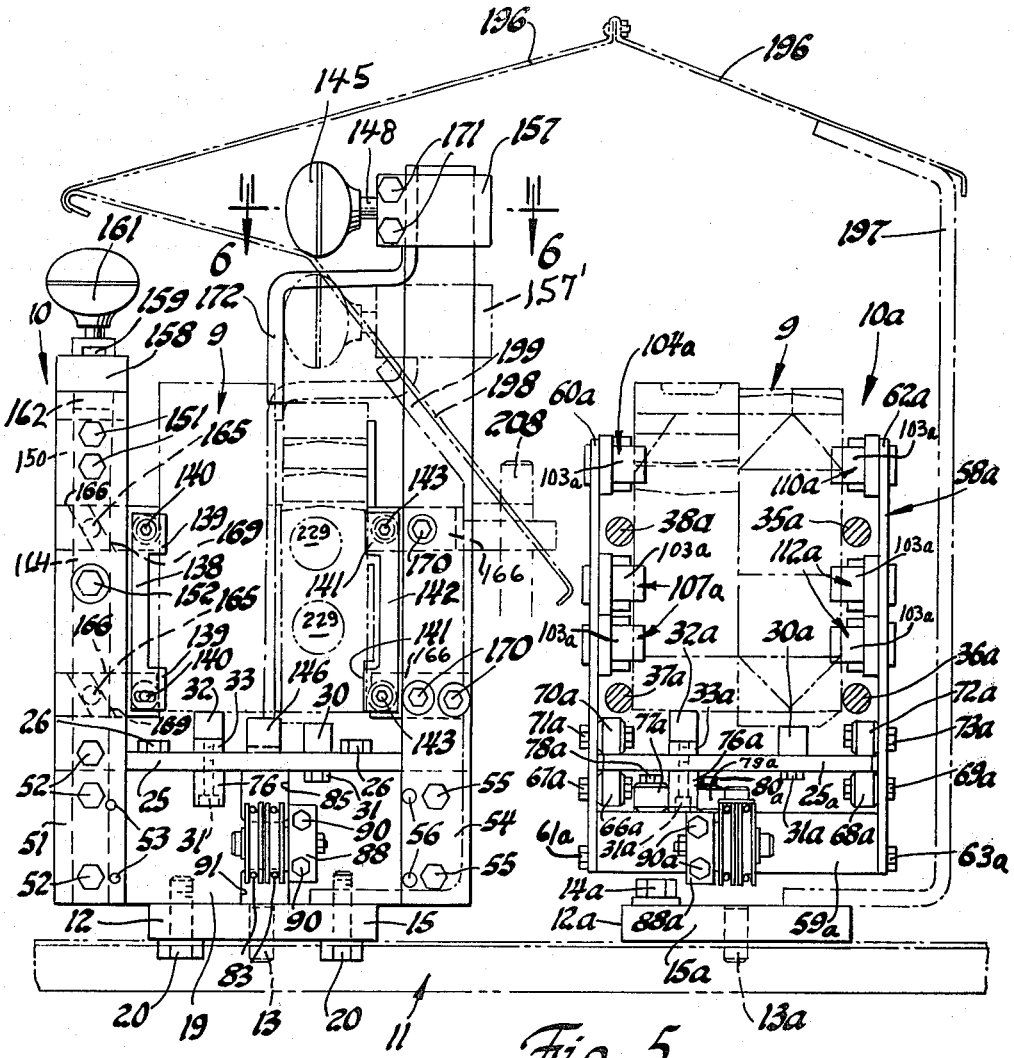
FIG. 5 is a front end elevation view, with parts removed, of the pair of inner and outer carton blank magazines of the present invention, taken along the line 5—5 of FIG. 1, and looking in the direction of the arrows.

The numeral 9 generally designates conventional coated paperboard cartons or containers which are processed by the magazines 10 and **10*a*. As illustrated in FIGS. 2, 2A and 5, the carton magazines 10 and 10*a* are operatively mounted on the packaging machine base plate, generally indicated by the numeral 11, with which the carton magazines 10 and 10*a* are operatively associated. The numeral 12 in FIGS. 2, 2A and 5 designate an elongated magazine base plate which is fixedly secured to the packaging machine base plate 11 by a plurality of suitable machine screws 14 and a centrally disposed dowel pin 13. The front end of the magazine base plate 12 is indicated by the numeral 15 in FIG. 1D, and the rear end thereof is indicated in FIG. 1C by the numeral 16**.

Figure 3:
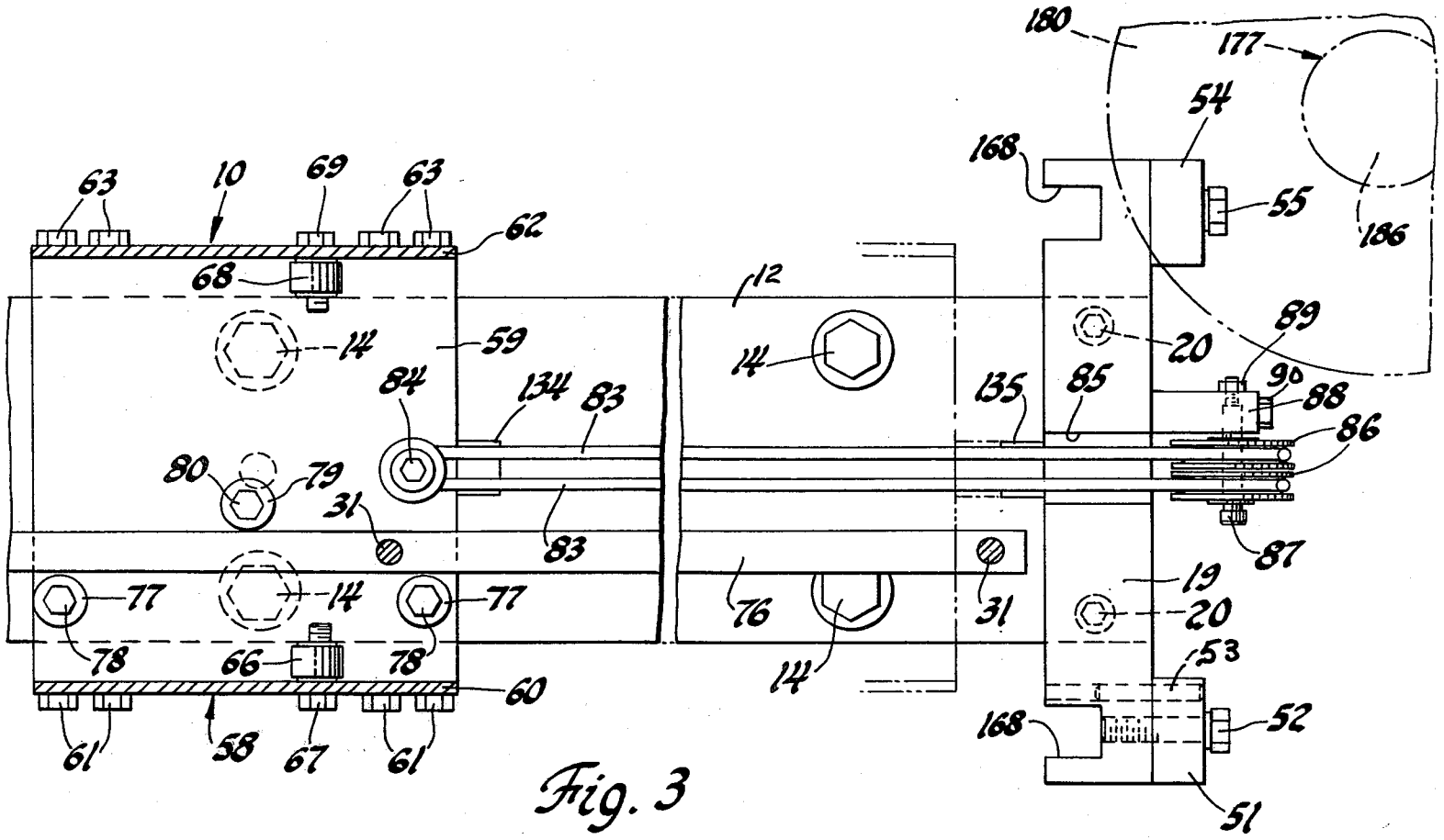
FIG. 3 is a fragmentary plan view of the outer carton blank magazine structure illustrated in FIG. 2A, with parts removed and parts in section, taken along the line 3—3 thereof, and looking in the direction of the arrows.

As shown in FIGS. 2A, 3 and 5, the magazine 10 includes a front mounting block 19 which is fixedly secured to the top side of the magazine base plate 12 by suitable machine screws 20. The magazine 10 further includes a rear mounting block 21 which is fixedly secured to the magazine base plate 12 by suitable machine screws 22. As shown in FIGS. 1C and 2A, a horizontal, elongated, carton slide support plate 25 is mounted on the front and rear mounting blocks 19 and 21 by suitable machine screws 26 and 27, respectively.

Figure 4:
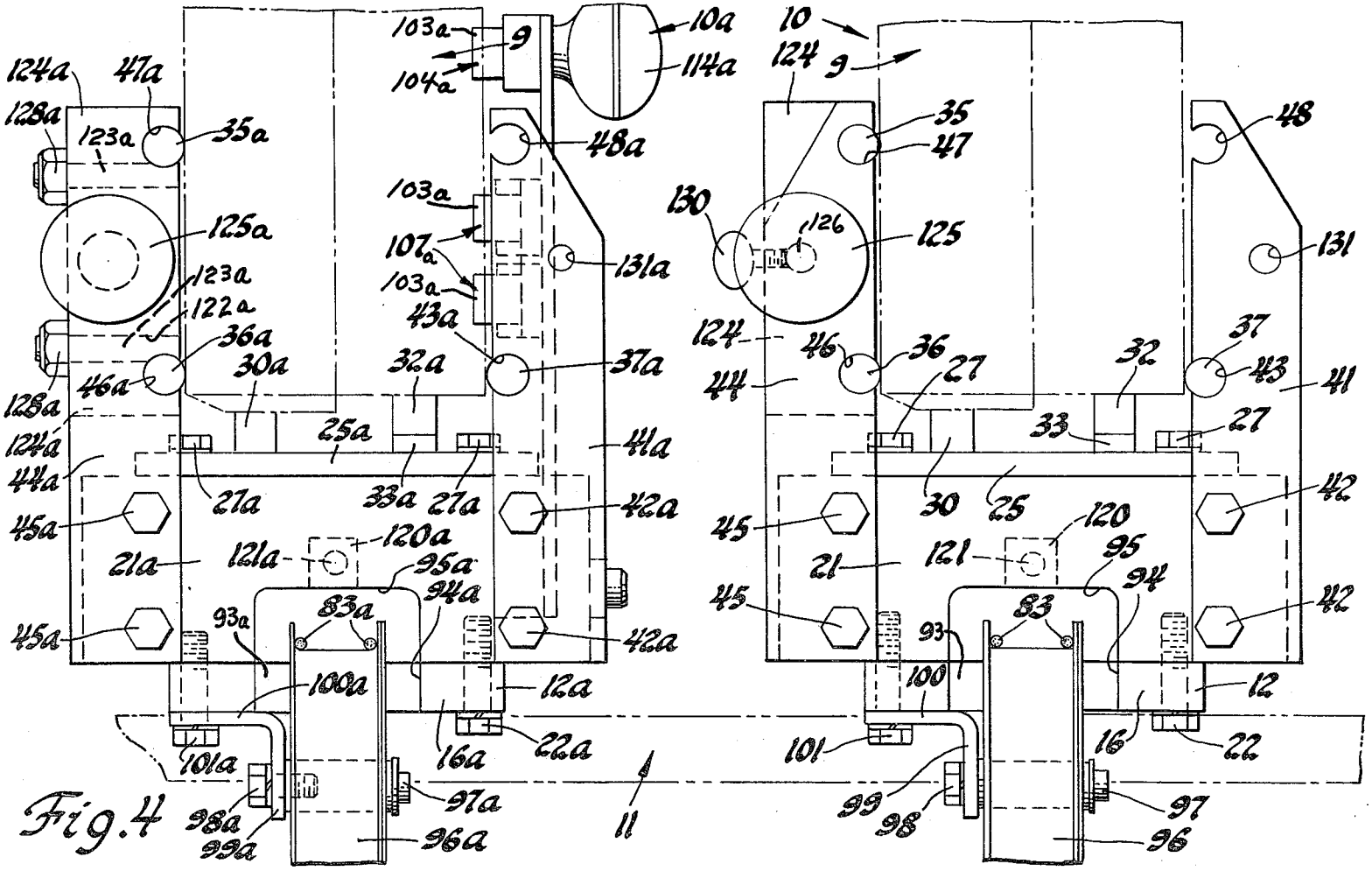
FIG. 4 is a rear end elevation view, with parts removed, of the pair of inner and outer carton blank magazines of the present invention, taken along the line 4—4 of FIG. 2, and looking in the direction of the arrows.

As best seen in FIGS. 1 and 5, a pair of longitudinal, laterally spaced apart, carton slide rails 30 and 32 are seated on top of the carton slide support plate 25, and they are fixedly secured thereto by suitable machine screws 31. As illustrated in FIGS. 4 and 5, the carton slide rail 30 has an elongated spacer plate 33 disposed thereunder to raise the carton slide rail 32 to have its upper surface higher than the upper surface of the carton slide rail 30.

As illustrated in FIG. 4, the magazine 10 has a pair of longitudinally disposed, vertically spaced apart, elongated, cylindrical carton guide rails 35 and 36 disposed along the inner side of the magazine 10, with the guide rail 35 being upwardly disposed from the guide rail 36. A similar elongated, cylindrical, carton guide rail 37 is operatively mounted along the outer side of the carton magazine 10. As shown in FIG. 1D, a short carton guide rail 38 is mounted above the outer carton rail 37, at the front end of the magazine 10. The numeral 38' designates the position of the short carton guide rail 38 when the magazines 10 and **10*a* are shifted in their position for changing the operations of the magazines 10 and 10*a* for use with a packaging machine with the opposite hand packaging machine. That is, the carton magazines 10 and 10*a* are shown in FIG. 1 as being disposed for operation with a right hand packaging machine and the carton guide rail 38 would be shifted to the opposite side of the magazine to a position marked 38'** when the magazines are used with a left hand packaging machine.

As shown in FIGS. 1, 1C and 4, the rear end of the carton guide rail 37 is operatively supported in a circular hole 43 in a vertically disposed guide plate 41. The guide plate 41 is fixedly secured to the rear face of the rear mounting block 21 by a plurality of suitable machine screws 42. As shown in FIG. 4, the rear ends of the guide rails 35 and 36 are operatively supported by a vertically disposed guide plate 44 which is secured to the rear end of the mounting block 21 by a plurality of suitable machine screws 45. The lower carton guide rail 36 is operatively supported in a circular hole 46 in the guide plate 44. The upper carton guide rail 35 is operatively supported in a circular hole 47 formed in the guide plate 44. As shown in FIG. 4, the guide plate 41 is provided with a second hole 48 which is disposed in vertical alignment above the guide rail hole 43 so that the magazine 10 may be converted to an opposite hand magazine by moving the carton guide rail 35 to the outer side, as viewed in FIG. 4 into the hole 48.

As shown in FIGS. 2A and 3, a vertical guide plate 51 is mounted on the front side of the outer end of the front mounting block 19 by a pair of suitable machine screws 52. As shown in FIG. 5, the vertical guide plate 51 is also secured to the front mounting block 19 by a pair of suitable locating pins 53. As shown in FIGS. 3 and 5, a second vertical guide plate 54 is secured to the inner end of the front mounting plug 19, on the front side thereof, by a pair of suitable machine screws 55 and a pair of suitable locating pins 56.

The magazine 10 is provided with a carton pusher means, generally indicated by the numeral 58 in FIGS. 1C, 2A and 3, for pushing or sliding the cartons 9 along the upper face of the carton slide rails 30 and 32 toward the right end or front end of the magazine 10, as viewed in FIG. 1. As shown in FIGS. 2A and 3, the carton pusher means 58 includes a horizontally disposed carrier plate 59 (59A in FIG. 5). The carrier plate 59 is disposed below the carton slide plate 25. As shown in FIG. 2A, the carton pusher means 58 includes an outer vertical side plate 60 which is secured at its lower end to the outer side of the carrier plate 59 by a plurality of suitable machine screws 61.

As shown in FIG. 3, an inner vertical side plate 62 is secured to the inner end of the carrier plate 59 by a plurality of suitable machine screws 63. As shown in FIG. 3 (FIG. 5 for magazine **10*a*) the carton pusher means 58 is provided with a guide roller 66, on the outer side thereof, which is secured to the inner face of the side plate 60 by a suitable horizontally disposed machine screw attachment means 67 which holds the roller 66 for rotation, about a horizontal axis, against the bottom face of the carton support plate 25. The carton pusher means 58 is also provided with a similar guide roller 68 on the inner side thereof, which is secured to the inner face of the side plate 62 by suitable horizontally disposed machine screw attachment means 69 which holds the roller 68 for rotation about a horizontal axis against the bottom face of the carton support plate 25. As shown in FIG. 2A, the carton pusher means 58 is rollably supported on top of the carton slide support plate 25 by a pair of longitudinally spaced apart support rollers 70 which are attached to the side plate 60, and a similar pair of support rollers 72 which are attached to the other side plate 62, as illustrated in FIG. 5, for the magazine 10*a*. The support rollers 70 and 72 are fixedly secured to the pusher side plates 60 and 62 by suitable machine screws 71 and 73**, respectively.

As shown in FIGS. 3 and 5, the magazine 10 further includes a roller guide rail 76 which is fixedly secured to the underside of the carton slide support plate 25 by the machine screws 31 which also hold the carton slide rail 32 on the top side of the carton slide support plate 25. The carton rails 32 and 76 are vertically aligned with each other. As best seen in FIG. 3, the carton pusher means 58 is provided with a pair of guide rollers 77 which are rollably engaged on one side of the roller guide rail 76, and a single inwardly disposed guide roller 79 which is rollably engaged on the opposite side of the roller guide rail 76. The guide rollers 77 and the guide roller 79 are secured to the carton pusher carrier plate 59 by suitable machine screws 78 and 80, respectively.

The carton pusher means 58 is moved to the right, as viewed in FIG. 1, by the following described structure. As shown in FIG. 3, a cable 83 is mounted around a suitable machine screw and washer combination 84 for securing the cable 83 to the carton pusher carrier plate 59. The two portions of the cable 83 are extended forwardly, or to the right as viewed in FIG. 3, through a slot 85 formed in the front mounting plate 19 and over a pair of cable pulleys 86. The pulleys 86 are mounted in a side-by-side relationship on a suitable shaft 87 which has a threaded end mounted through a pulley retainer block 88. The cable shaft 87 is secured in position in the retainer block 88 by a suitable lock nut 89. The pulley retainer block 88 is secured to the front face of the front mounting block 19 by suitable machine screws 90.

As shown in FIG. 5, the cable strands 83 are extended downwardly around the cable pulleys 86, and then backwardly through a cable slot 91 formed through the lower end of the front mounting block 19. As shown in FIGS. 2 and 2A, the two cable strands 83 extend rearwardly, or to the left as viewed in these figures, and over a cable pulley 96. As shown in FIG. 4, the cable pulley 96 is disposed in an elongated slot 94 formed through the magazine base plate 12. The numeral 93 in FIG. 2 indicates the inner end of the slot 94. The numeral 95 in FIG. 4 indicates an opening formed through the rear mounting block 21. As shown in FIG. 4, the cable pulley 96 is rotatably mounted on a suitable pulley shaft 97 which has one end threaded that is operatively mounted through a vertical flange 99 of a pulley bracket. The shaft 97 is secured to the bracket flange 99 by a suitable lock nut 98. The pulley bracket includes a horizontal flange 100 which is integrally attached to the flange 99. The pulley bracket flange 100 is secured to the lower face of the magazine base plate 12 by suitable machine screws 101. As shown in FIG. 2, the ends of the cable strands 83 are operatively attached to a suitable weight 81 which functions to maintain a tension on the cable strands 83 for exerting a pulling force on the carton pusher means 58 for pushing the cartons 9 toward the discharge end or right end of the magazine 10, as viewed in FIG. 1.

As shown in FIG. 1C, the carton pusher means 58 is provided with a carton pusher finger carrier member 104 at the upper end of the side wall 60 which is secured by suitable machine screws 105 to the side plate 60. The other side plate 62 is also provided with a carrier member 110 which is secured to the side plate 62 by suitable machine screws 111. The carrier members 104 and 110 are each provided with conventional spring biased carton pusher fingers 103.

As shown in FIG. 2A, the carton pusher side wall 60 is also provided with a lower pair of similar carrier members generally indicated by the numeral 107, which are secured to the side plate 60 by suitable machine screws 108. The carrier members 107 also carry suitable pusher fingers 103. As shown in FIG. 2A, the machine screws 105 for the carrier member 104 are mounted in a horizontal slot 106 in the side plate 60 to permit longitudinal adjustment of the carrier member 104. The machine screws 108 for the carrier members 107 are also operatively mounted in similar slots 109 in the side plate 60. The carrier pusher side plate 62 is also provided with a pair of lower carrier members 112 which are horizontally aligned with the carrier members 107, as indicated by the numerals **112*a* for the side plate 62*a* on the magazine 10*a***.

As shown in FIGS. 1 and 1C, the carton pusher means 58 is provided with a hand knob 114 which is fixed to the side plate 60, at the rear outer corner surface, by any suitable means so as to provide a hand knob for manually moving the carton pusher means 58 to the left, to an initial retracted position indicated in FIG. 1 by the numeral 58', to permit carton blanks 9 to be loaded into the magazine 10 on top of the slide rails 30 and 32 between the pusher fingers 103 and the discharge end of the magazine.

As best seen in FIGS. 1C and 2, the carton pusher means 58 is provided with a latch means for holding the carton pusher means 58 in the initial retracted position 58', and which comprises a swingably mounted lever arm 115. As viewed in FIG. 2, the left end of the latch lever 115 is pivotally mounted on a suitable machine screw 116 which is attached to the side face of the rear mounting block 21. The latch lever 115 is provided on the lower side, towards the front end thereof, with a square notch 117 which is adapted to receive a machine screw 118 when the latch lever is in the locking or holding position shown in FIG. 2. As shown in FIG. 1C, the machine screw 118 is threadably mounted in the lower rear corner of the side plate 60, and it is fixed in place by a suitable lock nut 119. The latch lever 115 permits the carton pusher means 58 to be held in the position 58' while the operator loads carton blanks 9 into the magazine 10. As shown in FIG. 2, a bumper 120 is secured to the inner face of the rear mounting block 21 by a suitable machine screw 121. As shown in FIG. 1C, the bumper 120 is centrally disposed in the magazine 10 so as to engage the rear face of the carton pusher means carrier plate 59 when the carton pusher means 58 is in the retracted position marked 58' in FIG. 1C.

As shown in FIGS. 1C and 2, and adjustment block 124 is operatively secured to the longitudinally disposed carton guide rails 35 and 36 for adjustably securing them in place in their respective holes 47 and 46, in the vertical guide plate 44. As shown in FIG. 2, the adjustment block 124 is vertically disposed, and it has threadably mounted therein a pair of transverse lock shafts 123 which are threadably mounted through threaded holes 122 in the block 124, and which have their inner ends formed to engage the guide rails 35 and 36 in friction engagement to secure them in place relative to the adjustment block 124. The lock shafts 123 are secured in place in an adjusted position in the adjustment block 124 by suitable lock nuts 128 (FIGS. 2 and 4). The adjustment block 124 is adapted to be longitudinally adjusted by a suitable, threaded adjusting stud 126 which has its outer end fixedly mounted in a threaded hole in a hand knob 125. The threaded stud 126 is threaded through a pair of spacer collars 129 and through a bore in the upper end of the inner guide plate 44. The spacer collars 129 are disposed on opposite sides of the guide plate 44 and are fixed to the stud 126 by suitable set screws 132. The stud 126 has its inner end threadably mounted in a bore 127 in the adjustment block 124. It will be seen that the spacer collars 129 retain the stud 126 against axial movement but allow rotation of the stud 126 to adjust the position of the block 124. The threaded stud 126 is held in an adjusted position by a suitable set screw 130. As shown in FIG. 4, the numeral 131 in the outer guide plate 41 permits the last described adjustment block structure to be shifted to the outer side of the magazine 10 to permit the magazine 10 to be used with a left hand packaging machine.

As shown in FIG. 2A, the carton pusher means 58 is provided on the front side thereof with a suitable bumper 134 which is secured by any suitable means, as by a suitable machine screw 136, to the carton pusher carrier plate 59. The bumper 134 is adapted to seat against a similar bumper 135 which is mounted by a suitable machine screw 137 to the inner face of the front mounting block 19.

As shown in FIGS. 2A and 5, a vertically disposed carton retainer strap 138 is positioned at the discharge end of the magazine 10 on the outer side. The upper and lower ends of the carton retainer strap 138 are fixedly secured to front ends of the vertically spaced apart carton guide rails 38 and 37, respectively, by suitable machine screws 140. As shown in FIG. 5, the carton retainer strap 138 has an integral upper, inwardly extended carton retainer finger 139 and an integral lower inwardly extended carton retainer finger 139. The carton retainer fingers 139 are disposed inwardly of the inner sides of the carton guide rails 35 and 37 so as to engage the outer edge of the frontmost carton 9 for releasably retaining it in the magazine 10 until it is removed by the hereinafter described carton feeder means.

As shown in FIG. 5, the inner side of the magazine 10 is also provided with a similar pair of carton retainer fingers 141 which are integrally formed on a vertically disposed carton retainer strap 142 which is secured to the front ends of the inner carton guide rails 35 and 36 by suitable machine screws 143. The carton retainer fingers 139 and 141 thus releasably engage the inner and outer side edges of the frontmost carton 9 to retain it in the magazine 10. The lower edge of the frontmost carton 9 is releasably retained by an upwardly extended edge on a centrally disposed carton retainer strap 146 which is secured to the front end of the carton slide support plate 25 by a suitable machine screw 146, as shown in FIG. 2A.

The carton guide rail 38 and the front end of the carton guide rail 37 are both adjustably mounted for lateral adjustment by the following described structure. As shown in FIGS. 1D and 2A, a horizontally disposed mounting bar 158 has its front end secured by suitable machine screws 159 to the top end of the vertical guide plate 51. An adjusting screw 160 is operatively mounted through a bore 174 formed vertically through the rear end of the mounting bar 158. The adjusting screw 160 is retained in place axially relative to the mounting bar 158, but it is permitted to rotate in the bore 174, by a pair of spacer collars 162 which are mounted on the top and bottom sides of the mounting bar 158 and secured relative to the screw 160 by suitable set screws 175. The upper end of the adjusting screw 160 has fixedly mounted thereon, by any suitable means, a hand knob 161. The lower end of the adjusting screw 160 is threaded, and it is threadably mounted in a vertically disposed threaded hole 163 which is formed in the upper end of a vertically disposed, movable, elongated adjustment bar 164. An upper guide bar 150 is secured to the inner face of the vertically disposed guide plate 51, in a position spaced below the mounting bar 158. The guide bar 150 is secured to the vertical guide plate 51 by suitable machine screws 151.

As shown in FIG. 2A, the lower end of the elongated adjustment bar 164 is slidably mounted through a square recess 168 that is formed through the rear face of the front mounting plate 19, at the outer end thereof. As shown in FIG. 1D, the inner end of the front mounting block 19 is also provided with a similar guide recess 168 for mounting the adjustment bar 164 on the inner side of the magazine 10 if it is desired to change the operation of the magazine from a right hand to a left hand packaging machine.

As shown in FIGS. 2A and 5, the vertical guide plate 51 is provided with a pair of vertically spaced apart, transverse recesses in which are movably mounted a pair of horizontal, transversely disposed retainer blocks 166 which have openings through the inner ends thereof that receive the carton guide rails 38 and 37. The retainer blocks 166 have vertically disposed set screws 167 in the inner ends thereof (FIG. 1D) for locking the last mentioned carton guide rails in the inner ends of the retainer blocks 166.

The retainer blocks 166 may be slidably moved, inwardly and outwardly, for simultaneous lateral adjustment of the carton guide rails 38 and 37, by the following described structure. As shown in FIG. 5, each of the transversely disposed retainer blocks 166 has formed in the rear face thereof an angularly disposed cam slot 169 in each of which is slidably mounted therein the front end of a cam dowel pin 165. As shown in FIG. 2A, the rear end of each of the dowel pins 165 is fixedly mounted, by any suitable means, as by a press fit, in the vertically disposed, movable adjustment bar 164. It will be seen, that when the vertically disposed adjustment bar 164 is moved upwardly and downwardly, by means of turning the hand knob 161, that the dowel pins 165 will coact with the cam slots 169 to cam the retainer blocks 166 inwardly or outwardly, as desired.

The elongated adjustment bar 164 is retained against lateral rearward movement out of the aforedescribed slot in the upper guide bar 150 and the guide slot 168 in the front mounting block 19 by a longitudinally disposed retainer screw 152, which is operatively mounted through the vertically disposed guide plate 51, and with its threaded end extended through a suitable vertical slot 176 formed through the adjustment bar 164 and into threaded engagement with a suitable lock nut 153. A spring 154 is mounted by means of a pair of washers 155 between the lock nut 153 and the rear face of the adjustment bar 164, for maintaining a spring biased pressure on the adjustment bar 164 to hold it in position during vertical adjustment of the same. As shown in FIG. 5, the inner carton guide rails are secured similarly to the inner ends of two vertically spaced apart, transverse inner retainer blocks 166. However, the inner retainer blocks 166 are fixedly secured in place by suitable machine screws 170.

Figure 6:
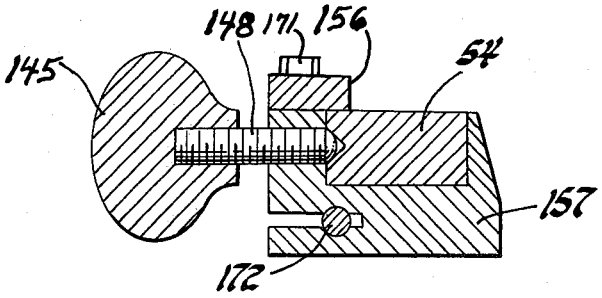
FIG. 6 is a fragmentary, enlarged, horizontal section view of the structure illustrated in FIG. 5, taken along the line 6—6 thereof, and looking in the direction of the arrows.

As shown in FIGS. 2A and 5, the upper edge of the frontmost carton 9 is releasably retained in the magazine 10 by an S-shaped retainer rod 172 which has a notch 173 on the lower end thereof for releasably engaging the upper edge of the frontmost carton 9 in the magazine 10. As illustrated in FIGS. 2A, 5 and 6, the upper end of the S-shaped retainer rod 172 is releasably secured in a vertical hole formed in the inner end of a slot that is formed in a vertically adjustable C-clamp member 157. As shown in FIG. 6, the C-clamp member 157 is slidably mounted around three sides of the upper end of the vertical guide plate 54, and it is held in an adjusted position by a suitable lock screw 148 which is threadably mounted through one arm of the C-clamp 157. The outer end of the lock screw 148 is fixedly mounted in a hand knob 145. The inner end of the lock screw 148 is adapted to be seated in a V-shaped groove formed in one side of the vertical guide plate 54, as shown in FIG. 6, for clamping the C-clamp 157 on the guide plate 54. As shown in FIGS. 5 and 6, a vertical retainer plate 156 retains the C-clamp 157 on the guide plate 54. The retainer plate 156 is secured to the C-clamp 157 by a pair of suitable machine screws 171 which also function to hold the upper end of the retainer rod 172 in a squeezed position in its hole in the C-clamp 157. It will be understood that the C-clamp 157 may be adjusted upwardly and downwardly for positioning the retainer rod 172 at different heights for different size cartons.

The numeral 149 in FIG. 1D designates an adjusting block which is similar to the adjusting block 124 and which would be used for adjusting the carton guide rails at the right end of the magazine 10, if the magazine were re-adjusted for an opposite hand packaging machine, as for example, if it were changed to operate with a left hand packaging machine.

As shown in FIG. 5, the carton magazines 10 and **10*a* may have disposed thereover a suitable upper front cover plate 196** and a suitable upper rear cover plate 196, and which cover plates 196 are joined together at their inner ends by any suitable means. The outer end of the upper rear cover plate 196 is suitably supported, as by a support brace 197 which has its lower end suitably supported on the magazine base plate 15*a*. The front end of the upper front cover plate 196 is suitably supported by an inwardly extended lower cover plate 198 which slopes inwardly over the front end of the outer carton magazine 10. The cover plate 198 is suitably supported by a bracket support post 208 which has its lower end supported on the machine base plate 11 in any suitable manner. The last described cover plate structure provides protection for the carton magazines 10 and 10*a* to keep contamination from falling on the cartons 9 while they are being processed by the carton magazines. The carton magazines 10 and 10*a* are adapted to be mounted at a low level so that the operator does not have to lift the new batch of cartons 9 very high when placing them in the carton magazines 10 and 10*a*. The right side of the cover plate 198, as viewed in FIG. 5, can also be used by an operator for squaring up a load of cartons 9 before depositing them in the inner carton magazine 10*a*. The cover plate 198 may also be used to assist the operator in guiding a new batch of cartons 9 into the outer carton magazine 10.

As generally indicated in FIG. 1, a carton feeder means, generally indicated by the numeral 177, is operatively mounted at the front or right end of the outer carton magazine 10 for removing collapsed cartons 9 from the outer carton magazine 10, one at a time, and moving them to an expanded position for subsequent loading onto a mandrel on a carton forming, filling and closing machine. A similar carton feeder means 177*a* is also positioned at the front or right end of the inner carton magazine 10*a* for performing the same operation, and the parts thereof have been marked with the same reference numerals as used to describe the parts of the carton feeder means 177, followed by the small letter "a".

Figure 7:
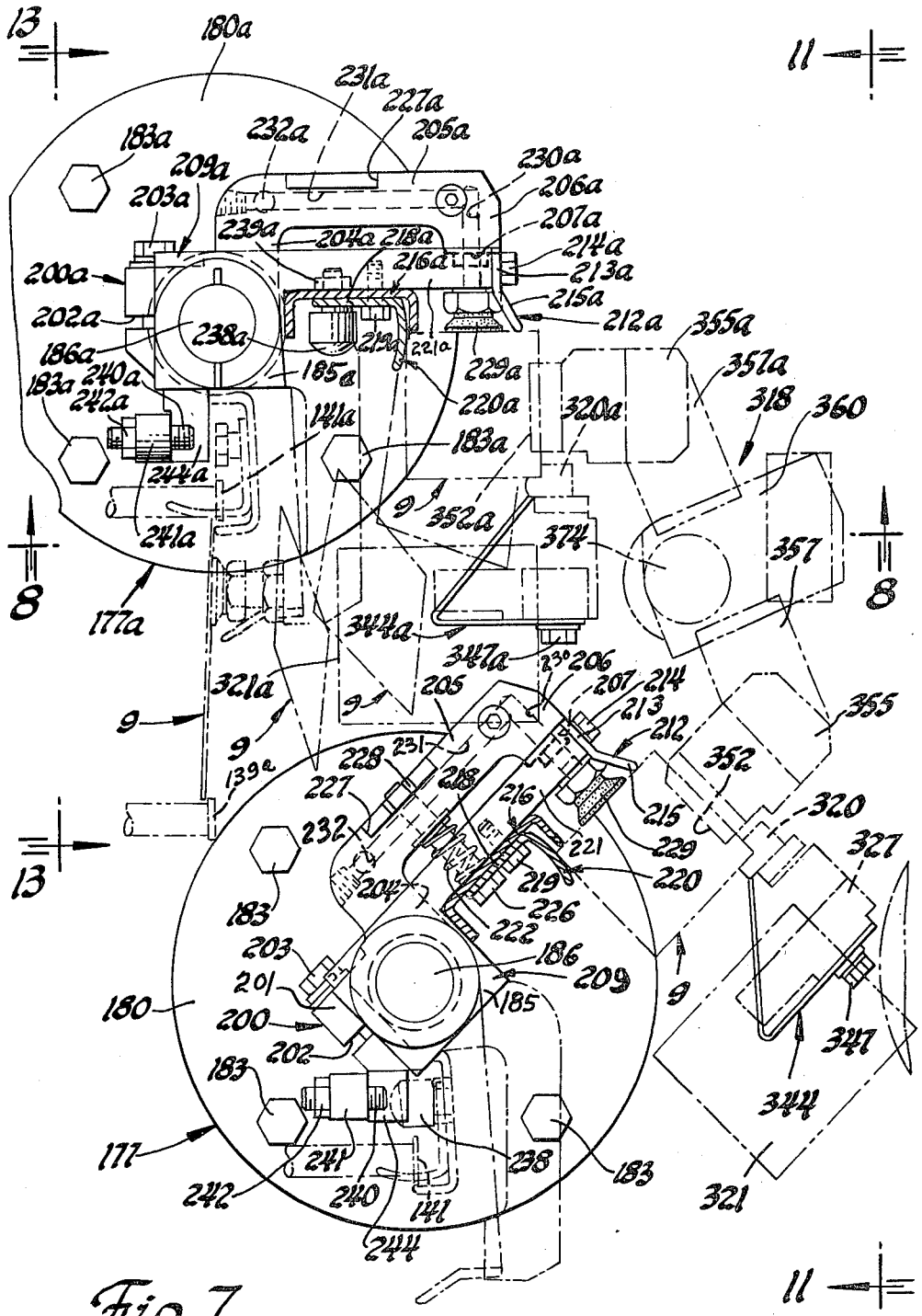
FIG. 7 is a top plan view, of a pair of inner and outer carton blank feeders for withdrawing carton blanks from the inner and outer carton blank magazines shown in FIGS. 1 through 6 and for expanding them for subsequent loading onto mandrels on a carton forming, filling and closing machine, with parts removed, and taken in the direction of the arrow marked "7" in FIG. 2A.
Figure 11:
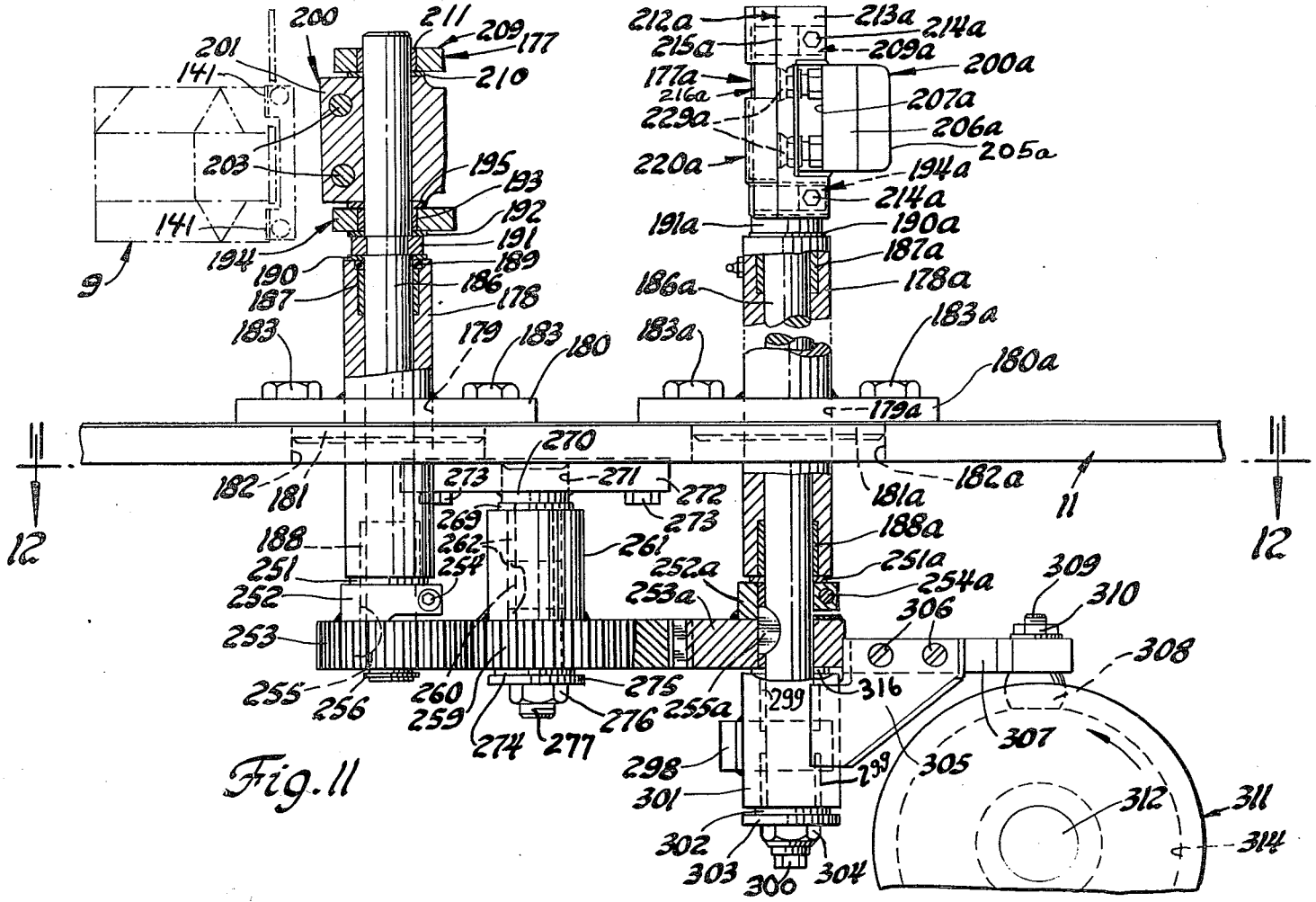
FIG. 11 is a right side elevation view, with parts removed and parts in section, of the carton feeder structure illustrated in FIG. 7, taken along the line 11—11 thereof, and looking in the direction of the arrows.

As shown in FIGS. 7 and 11, the carton feeder means 177 includes a vertically disposed pivot shaft 186 which is rotatably mounted in a vertically disposed mounting shaft 178 that is mounted through a bore 179 formed through a carton feeder base plate 180.

As shown in FIG. 11, the carton feeder base plate 180 is provided with a downwardly extended integral hub 181 which is seated in a bore 182 formed through the packaging machine base plate 11.

The carton feeder base plate 180 is fixedly secured to the packaging machine base plate 11 by suitable machine screws 183.

As shown in FIG. 11, the carton feeder pivot shaft 186 is operatively mounted in the fixed mounting shaft 178, for oscillation therein, by an upper sleeve bearing 187 and a lower sleeve bearing 188. As shown in FIG. 11, a suitable annular seal member 189 is mounted in the fixed mounting shaft 178, on the upper end of the upper sleeve bearing 187. A suitable thrust washer 190 is mounted on the upper end of the mounting shaft 187, and seated thereon, and around the pivot shaft 186 is a suitable split collar member 191. A suitable thrust washer 192 is mounted around the pivot shaft 186 on top of the split collar 191, and seated on the top side of the thrust washer 192 is one end of a swinging feeder arm, generally indicated by the numeral 194. A thrust washer 195 is seated around the pivot shaft 186 on the top side of the swinging feeder arm 194. The feeder arm 194 is pivotally mounted on the pivot shaft 186 by means of a sleeve bearing 193. A carrier member, generally indicated by the numeral 200, is mounted on the pivot shaft 186 on top of the thrust washer 195. The carrier member 200 has a hub portion 201 which has a suitable bore therethrough in which is received the pivot shaft 186. As shown in FIG. 7, the outer end of the hub portion 201 is slotted, and the slotted hub end portions are secured together by suitable machine screws 203 for fixedly securing the carrier member 200 to the pivot shaft 186. An upper swinging feeder arm, generally indicated by the numeral 209, is pivotally mounted on the upper end of the pivot shaft 186 by means of a thrust washer 210 and a sleeve bearing 211.

As shown in FIG. 7, the carrier member 200 includes an integral, rearwardly extended arm portion 204 which is integral with an offset horizontal transverse portion 205 that has an integral forwardly extended arm portion 206, so as to form an overall U-shaped carrier body, as shown in plan view in FIG. 7. The numeral 207 designates the front end of the forwardly extended carrier arm portion 206.

Figure 8:
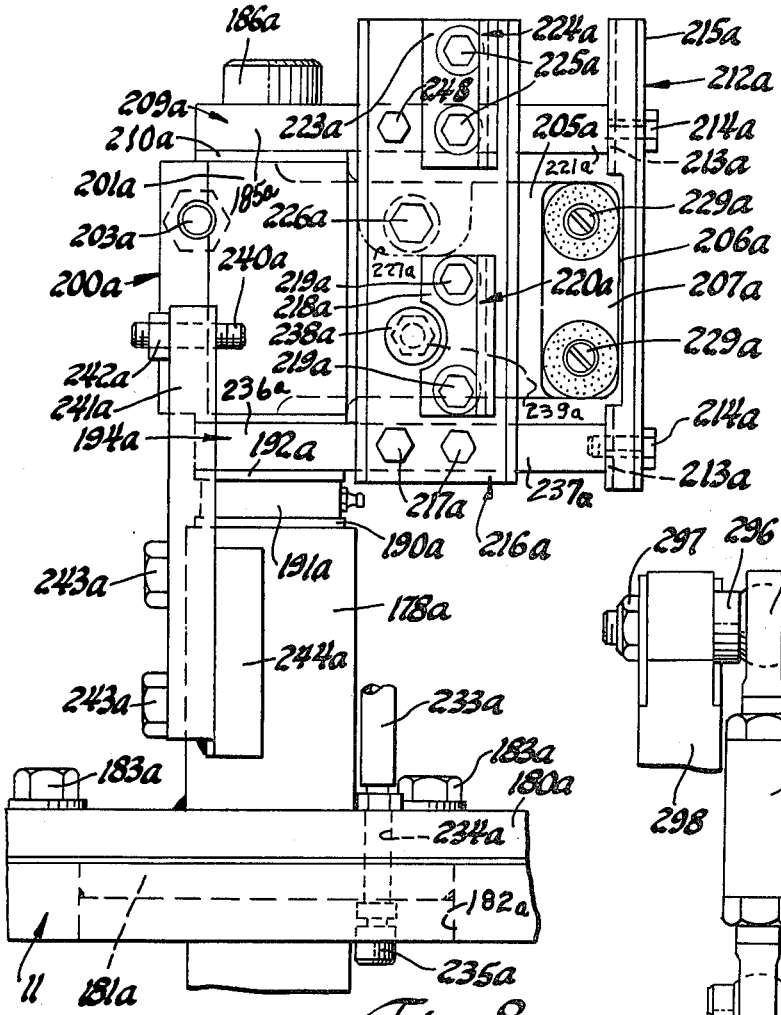
FIG. 8 is a fragmentary, elevational view of the carton feeder structure illustrated in FIG. 7, taken along the line 8—8 thereof, and looking in the direction of the arrows.
Figure 10:
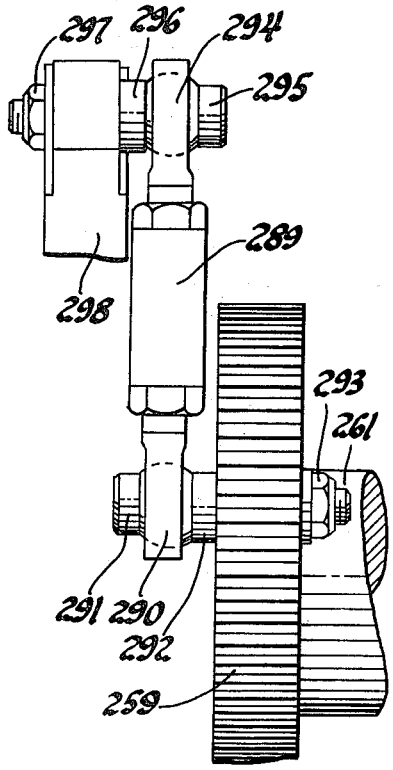
Figure 9:
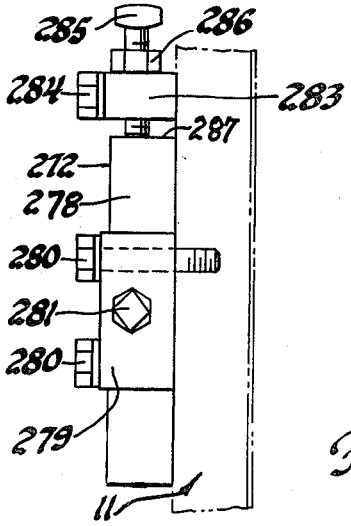
FIG. 9 is a fragmentary, elevational view of the power drive structure for the carton feeder drive means illustrated in FIG. 12, taken along the line 9—9 thereof, and looking in the direction of the arrows.

As shown in FIG. 7, the upper swinging feeder arm 209 includes a square shaped hub 185 which is integral with a straight body portion 221 that extends above, and forwardly offset from, the carrier body portions 204, 205 and 206, but which is parallel with the carrier body portion 205. As shown in FIG. 8, which shows the carton feeder means 177*a*, the lower swinging feeder arm 194 is formed to the same shape as the upper swinging feeder arm 209, and it includes the hub portion 236 that is mounted on the shaft 186, and the elongated integral body portion 237 which is parallel to the body portion 221 of the upper swinging feeder arm 209. As illutrated in FIGS. 8 and 11, the carrier member 200 is disposed vertically between the upper and lower swinging feeder arms 209 and 194.

As shown in FIGS. 7 and 8, a vertically disposed bowing bar, generally indicated by the numeral 212, is mounted to the outer ends of the swinging feeder arm body portions 221 and 237. The bowing bar 212 comprises a pair of vertically spaced apart mounting flanges 213 which are secured by suitable machine screws to the outer ends of the feeder arm body portions 221 and 237. The bowing bar 212 includes a vertically disposed integral carton engaging flange 215 which is adapted to engage one side of the carton when it is swung to the opened position shown in FIG. 7. The bowing bar 212 is assisted in its bowing action to make a collapsed carton 9 open after it is withdrawn from the magazines 10 and 10*a* by a bowing channel, generally indicated by the numeral 216, and a pair of lower and upper guide angle bars, generally indicated by the numerals 220 and 224.

As shown in FIG. 8, the bowing channel 216 is secured to the lower swinging arm body portion 237 by a pair of machine screws 217. The upper end of the bowing channel 216 is secured to the arm portion 221 of the upper swinging feeder arm 209 by one machine screw 225 and one machine screw 248. The upper guide angle bar 224 has its body flange 223 secured to the transverse body portion of the bowing channel 216 by two of the machine screws 225. As shown in FIG. 8, the lower guide angle bar 220 has its body flange 218 secured to the inner face of the transverse body portion of the bowing channel 216 in a position aligned vertically with the upper angle bar 224 by a pair of suitable machine screws 219.

As shown in FIGS. 7 and 8, the bowing channel 216 is attached to the body portion 205 of the carrier member 200 by a machine screw 226 which extends through the transverse body portion of the bowing channel 216 and through a suitable bore formed through the carrier member body portion 205 and into a recess 227 formed in the rear face of the carrier member body portion 205. A compression coil spring 222 is mounted between the rear face of the bowing channel 216 and the inner face of the carrier member body portion 205. The machine screw 226 is secured in position by a suitable lock nut 228 which is seated in the recess 227 in the carrier member body portion 205.

As shown in FIGS. 7 and 8, each of the carton feeder means 177 and 177*a* is provided with a pair of vertically disposed conventional vacuum cups 229 which are operatively mounted in the usual manner on the face 207 of the carrier member body portion 206. The vacuum cups 229 are vertically spaced apart, and as illustrated in FIG. 7, each of the vacuum cups 229 are connected by suitable vacuum passageways 230 and 231 to a vacuum inlet port 232 in the carrier member body portion 205.

It will be understood that the vacuum port 232 would be connected to the upper end of a suitable vacuum hose 233 (FIG. 8). The vacuum hose 233 is shown in FIG. 8 as having its lower end attached to a suitable vacuum passage 234 formed through the carton feeder base plate 180 and the machine base plate 11. A suitable vacuum supply fitting 235 is shown attached to the inlet end of the vacuum passage 234, and it would be connected to a suitable source of the vacuum for operating the vacuum cups 229 in the usual manner for withdrawing cartons 9 from the carton magazines 10 and 10*a*.

As shown in FIGS. 7 and 8, each of the carton feeder means 177 and 177*a* is provided with a suitable bumper 238, which may be made from any suitable resilient material. The bumper 238 is mounted on a suitable mounting screw which extends through the transverse body portion of the bowing channel 216 and is secured thereto by a suitable lock nut 239. As illustrated in FIG. 7, when the swinging carton feeder means 177 and 177*a* are rotated to the broken line positions for removing a carton 9 from the carton magazines 10 and 10*a*, they are prevented from over-travelling in that direction by the engagement of the bumpers 238 and 238*a* with longitudinally disposed abutment screws 240 and 240*a*, which are threadably mounted through vertically disposed abutment screw carrier bars 241 and 241*a*. Each of the abutment screws 240 is secured in an adjusted position in the carrier bar 241 by a suitable lock nut 242. As illustrated in FIG. 8, each of the carrier bars 241 is secured by suitable machine screws 243 to a vertically disposed mounting bar 244 which is fixed, as by welding, to the mounting shaft 178.

The carton feeder means 177 and 177*a* are adapted to be swung between the solid line positions shown in FIG. 7 and the broken line positions shown in FIG. 7 by the following described power drive means. As shown in FIG. 11, a driven gear 253 is operatively mounted on the lower end of the pivot shaft 186 for operating the carton feeder means 177. The driven gear 253 has a suitable locking collar 252 fixed to the upper face thereof by any suitable means, as by welding. The locking collar 252 is secured to the lower end of the pivot shaft 186 in a position below the mounting shaft 178, and spaced therefrom by a suitable thrust washer 251. The locking collar 252 and the driven gear 253 are secured to the pivot shaft 186 by a lock screw 254 and a key 255. A suitable retainer ring 256 is mounted on the lower end of the pivot shaft 186. A driven gear 253*a* is attached to the lower end of the pivot shaft 186*a* for operating the carton feeder means 177*a* in the same manner, and the similar parts have been marked with the same reference numerals followed by the small letter "a".

Figure 12:
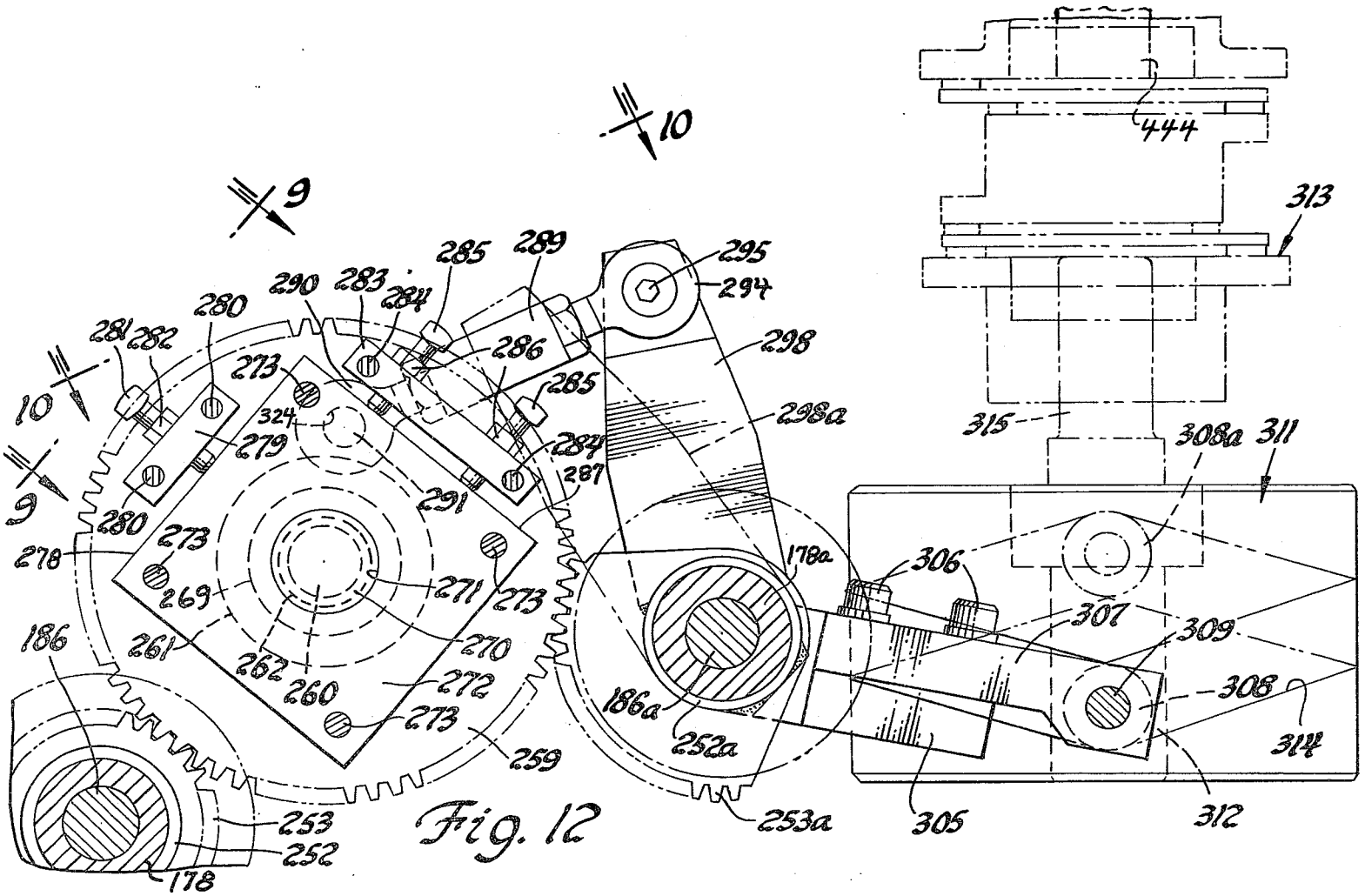
FIG. 12 is a horizontal section view of the carton feeder power drive means structure illustrated in FIG. 11, taken along the line 12—12 thereof, and looking in the direction of the arrows.

As shown in FIGS. 11 and 12, the driven gears 253 and 253*a* are meshed with and driven by a drive gear 259. As shown in FIG. 11, the drive gear 259 is operatively secured to the lower side of the machine base plate 11 by the following described structure. The drive gear 259 is secured as by welding to a tubular mounting shaft 261 which is rotatably mounted by a pair of suitable sleeve bearings 262 on a fixed shaft 260. The upper end of the shaft 260 is made to an enlarged diameter, as indicated by the numeral 270, and a suitable thrust washer 269 is mounted between the lower end of the enlarged diameter shaft portion 270 and the upper end of the rotatable mounting shaft 261. The enlarged diameter upper end shaft portion 270 is seated in a vertical bore 271 formed in a mounting plate 272, and it is fixed thereto by any suitable means, as by welding. As shown in FIG. 11, the mounting plate 272 is secured by suitable machine screws 273 to the lower face of the machine base plate 11. The drive gear 259, and its mounting shaft 261, is retained on the shaft 260 by a suitable thrust washer 274, an enlarged diameter washer 275, and a suitable lock nut 276 which is mounted on the reduced diameter threaded lower end portion 277 of the shaft 260.

As shown in FIG. 12, the mounting plate 272 may be precisely positioned by a jack screw means which includes a first jack screw mounting block 279 that is secured by suitable machine screws 280 to the under surface of the machine base plate 11 in a position spaced from the mounting plate 272. A jack screw or set screw 281 is threadably mounted through the jack screw mounting block 279, with its inner end in an abutting position against the side surface 278 of the mounting plate 272. The jack screw 281 can thus be used to exert a shifting pressure on the mounting plate 272 in the direction of the axis of the screw 281. The jack screw 281 is held in an adjusted position by a suitable lock nut 282. A second jack screw mounting block 283 is positioned at right angles to the first jack screw mounting block 279 in a position spaced apart from an adjacent right angular side surface 287 on the mounting plate 272. The second jack screw mounting block 283 is secured by suitable machine screws 284 to the under surface of the machine mounting base plate 11. A pair of spaced apart jack screws or set screws 285 are threadably mounted through the jack screw mounting block 283, and they have their inner ends in an abutting position with the side surface 287 of the mounting plate 272 for exerting an adjusting pressure on the mounting plate 272 from a direction perpendicular to the axis of the first mentioned jack screw 281. The jack screws 285 are each locked in an adjusted position by a lock nut 286.

Figure 10:
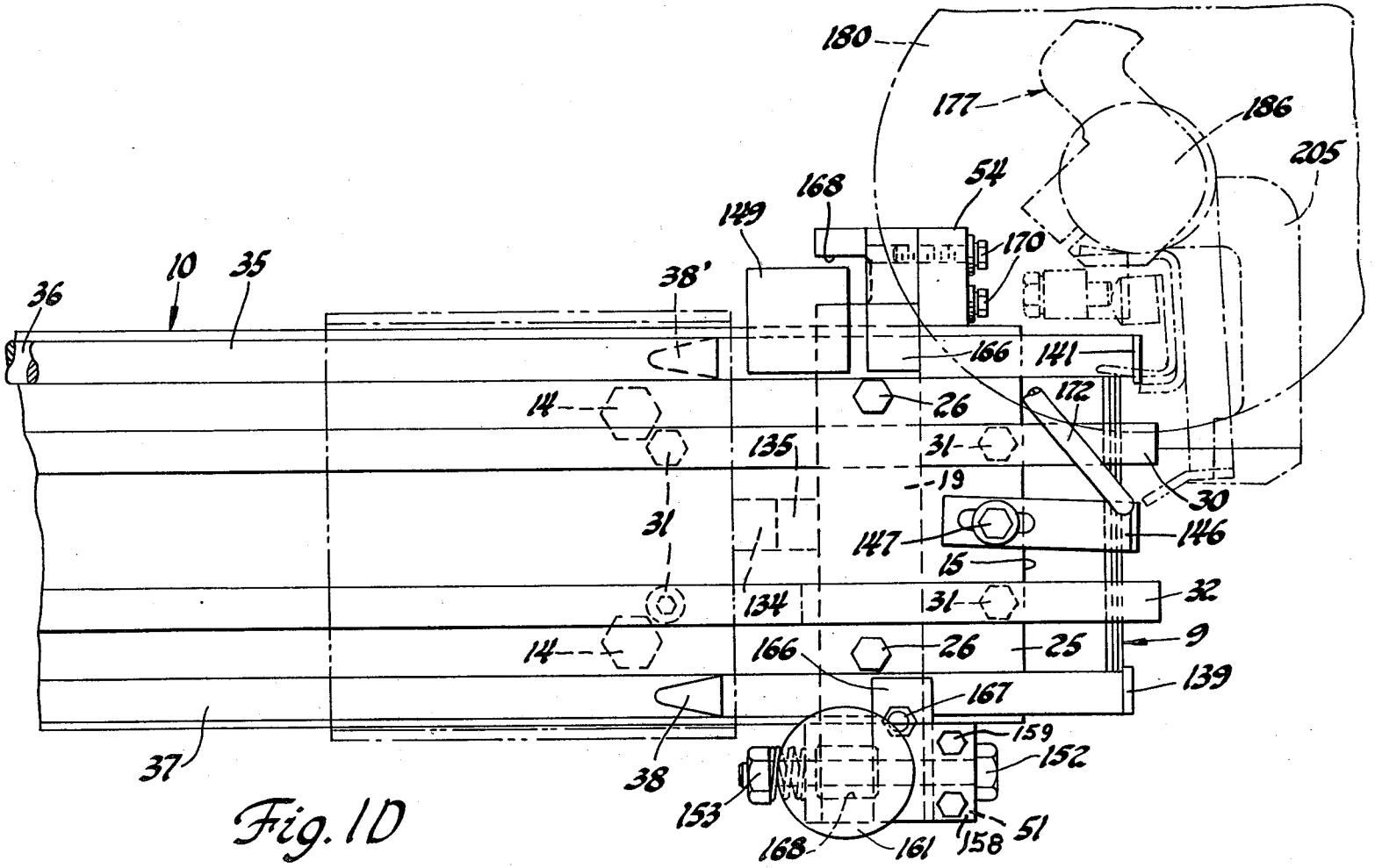
FIG. 10 is a fragmentary, elevational view of the carton feeder power drive means illustrated in FIG. 12, taken along the line 10—10 thereof, and looking in the direction of the arrows.

The drive gear 259 is oscillated, so as to operate the feeder mechanisms 177 and 177*a*, by the following described structure. As shown in FIGS. 10 and 12, a connecting rod has a first rod end member 290 connected by a suitable shoulder screw shaft 291 and a sleeve spacer 292 to the drive gear 259. The screw shaft 291 passes through a suitable bore 324 (FIG. 12) formed through the drive gear 259, in a position offset from the axis of the gear 259 and parallel thereto. The rod shaft 291 is secured to the drive gear 259 by a suitable lock nut 293.

The connecting rod structure includes a spacer member 289 which interconnects the rod end 290 with a second rod end 294 (FIG. 10). The rod end 294 is operatively connected by a shoulder screw shaft 295 and a spacer sleeve 296 to one end of a drive lever 298. The screw shaft 295 is extended through a suitable bore in one end of the drive lever 298 and it is secured thereto by a suitable lock nut 297.

As shown in FIG. 11, the other end of the driver lever 298 is attached, as by welding, to the outer face of a drive lever tubular mounting shaft 301. The mounting shaft 301 is rotatably mounted on the extended lower end of the feeder pivot shaft 186*a* by a pair of suitable sleeve bearings 299. The upper end of the lever mounting shaft 301 is spaced from the lower face of the driven gear 253*a* by a suitable thrust washer 316. The lever mounting shaft 301 is retained on the pivot shaft 186*a* by a thrust bearing 302, an enlarged diameter washer 303, and a lock nut 304 which is threadably mounted on a threaded reduced diameter lower end 300 of the pivot shaft 186*a*.

As shown in FIG. 11, the lever mounting shaft 301 is fixed, as by welding, to one end of a suitable lever bar 305. The other end of the lever bar 305 is secured by machine screws 306 to one end of a carrier bar 307, as shown in FIG. 12. The other end of the carrier bar 307 carries a cam follower 308 which is secured to the carrier bar 307 by a suitable mounting screw or shaft 309. As shown in FIG. 11, the cam follower 308 is secured to the carrier bar 307 by a suitable lock nut and washer assembly 310.

As shown in FIG. 11, the cam follower 308 is adapted to be operatively disposed in a cam track 314 which is formed in the outer periphery of a rotary barrel cam, generally indicated by the numeral 311. As shown in FIG. 12, the barrel cam 311 is operatively mounted on a shaft 312 which has an extension 315 that is operatively connected to a suitable shaft coupling, generally indicated by the numeral 313. The coupling 313 is adapted to be attached to the main drive shaft 444 of the packaging machine with which the feeder mechanism of the present invention is associated for driving the feeder means 177 and 177*a*.

It will be seen, that when the barrel cam 311 is rotated counterclockwise, as viewed in FIG. 11, that the cam follower 308 will ride in the cam track 311 in the outer periphery of the barrel cam 311 and move the cam follower between the position indicated in FIG. 12 by the numeral 308 and the broken line position of FIG. 12 indicated by the numeral 308*a*, so as to oscillate the bars 307 and 305, and in turn oscillate the lever shaft 301. The lever 298 is thus oscillated between the solid line position shown in FIG. 12 and the broken line position 298*a* shown in FIG. 12, so as to oscillate the drive gear 259 back and forth and provide an oscillating action to the gears 253 and 253*a* and their associated carton feeder means 177 and 177*a*, respectively.

Figure 13:
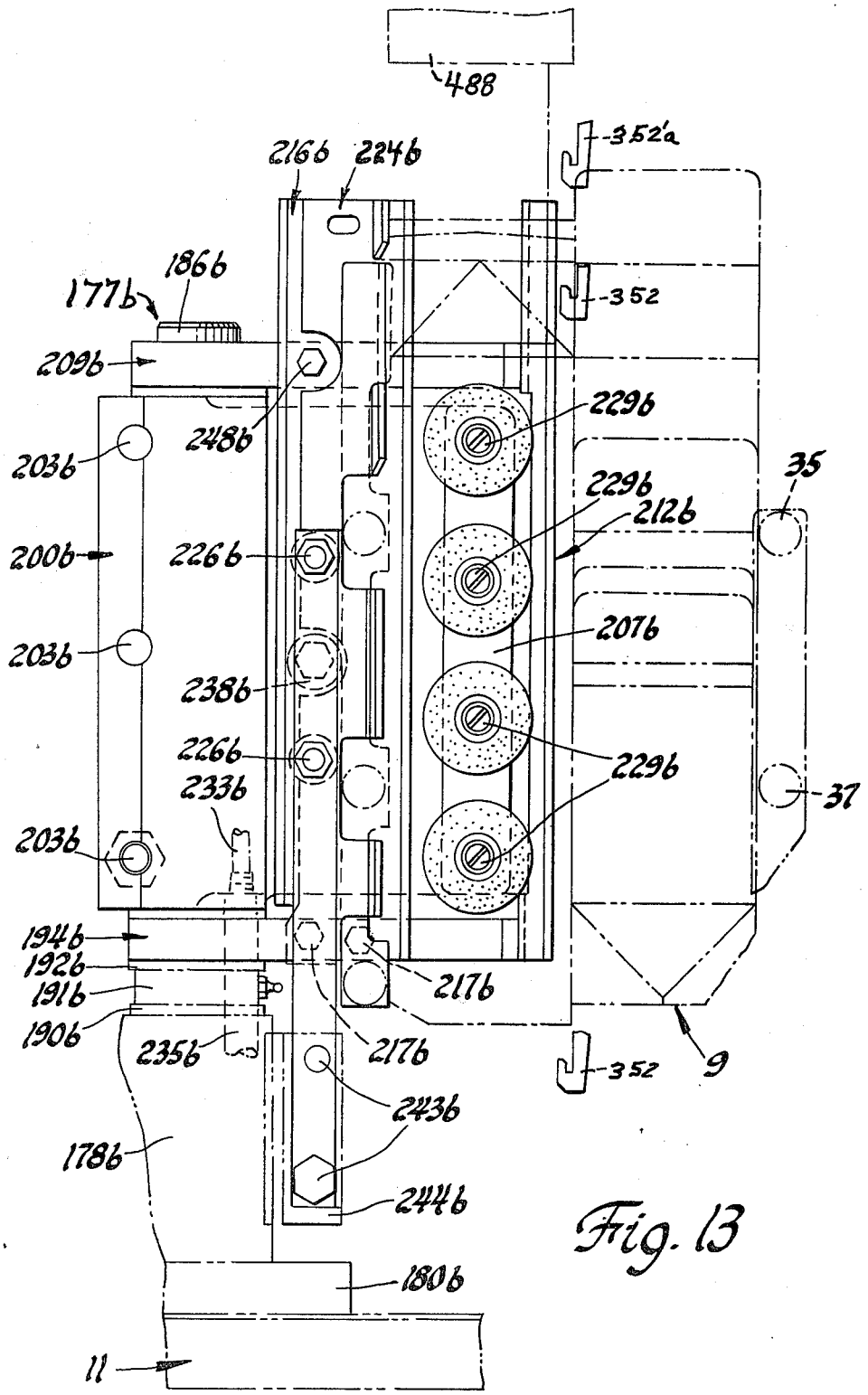
FIG. 13 is an elevation view of a carton feeder structure, similar to FIG. 8, and showing a carton feeder modified for a half-gallon size carton.

The carton feeder structure illustrated in FIG. 8 employs only two vacuum cups 229, and it is adapted for feeding small size cartons. FIG. 13 illustrates a carton feeder means, indicated by the numeral 177*b*, which employs four vacuum cups 229 for feeding a larger size carton, such as a quart carton. The parts of the feeder means 177*b* which are the same as the parts of the carton feeder means 177 and 177*a* have been marked with the same reference numerals followed by the small letter "b". The carton feeder mechanism 177*b* functions in the same manner as the carton feeder means 177 and 177*a*.

FIGS. 14 through 19 illustrate a carton loading means, generally indicated by the numeral 318, which simultaneously feeds a pair of expanded cartons upwardly onto suitable conventional mandrels on a carton forming, filling and closing machine. FIGS. 20 through 24 disclose a power drive means for the carton loader means 318.

Figure 14:
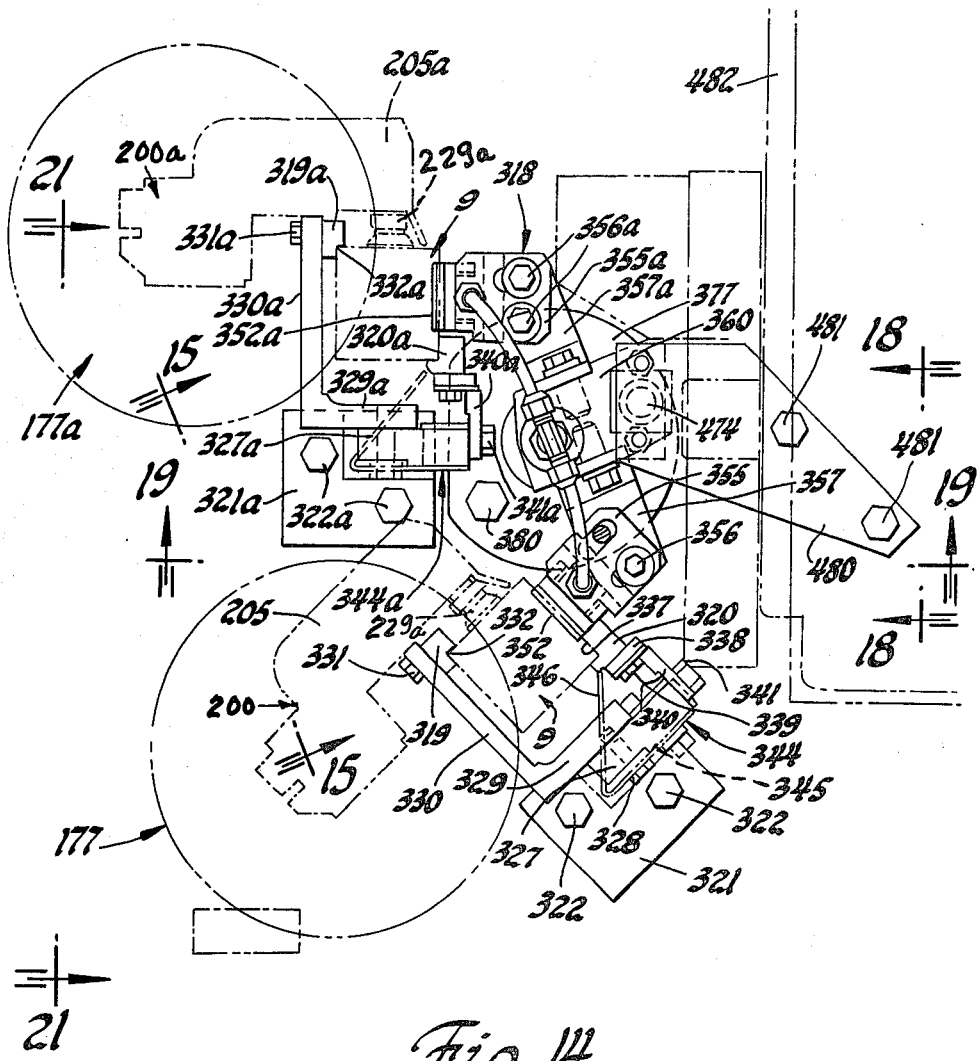
FIG. 14 is a top plan view of a carton loader means for use with the carton feeders illustrated in FIG. 7, and for loading a pair of cartons onto a pair of mandrels on a carton forming, filling and closing machine.

As shown in FIG. 14, the carton loader means 318 includes an elongated first carton guide member 319 and a diagonally disposed second carton guide member 320 which are vertically disposed adjacent the position at which the carton feeder means 177 reaches its fully retracted position and has expanded a carton 9 which it has withdrawn from the magazine 10. A second set of identical carton guide members 319*a* and 320*a* are also disposed in similar positions adjacent the retracted position of the carton feeder means 177*a*, as shown in FIG. 14. The parts of the carton guide members 319*a* and 320*a* which are the same as the parts of the carton guide members 319 and 320 have been marked with the same reference numerals followed by the small letter "a".

As illustrated in FIG. 14, the carton guide members 319 and 319*a* are each operatively mounted by suitable bracket structure on a separate mounting plate as 321 and 321*a*, respectively, on the machine base plate 11. The mounting plates 321 are fixedly secured to the machine base plate 11 by suitable machine screws 322 and 322*a*.

Figure 19:
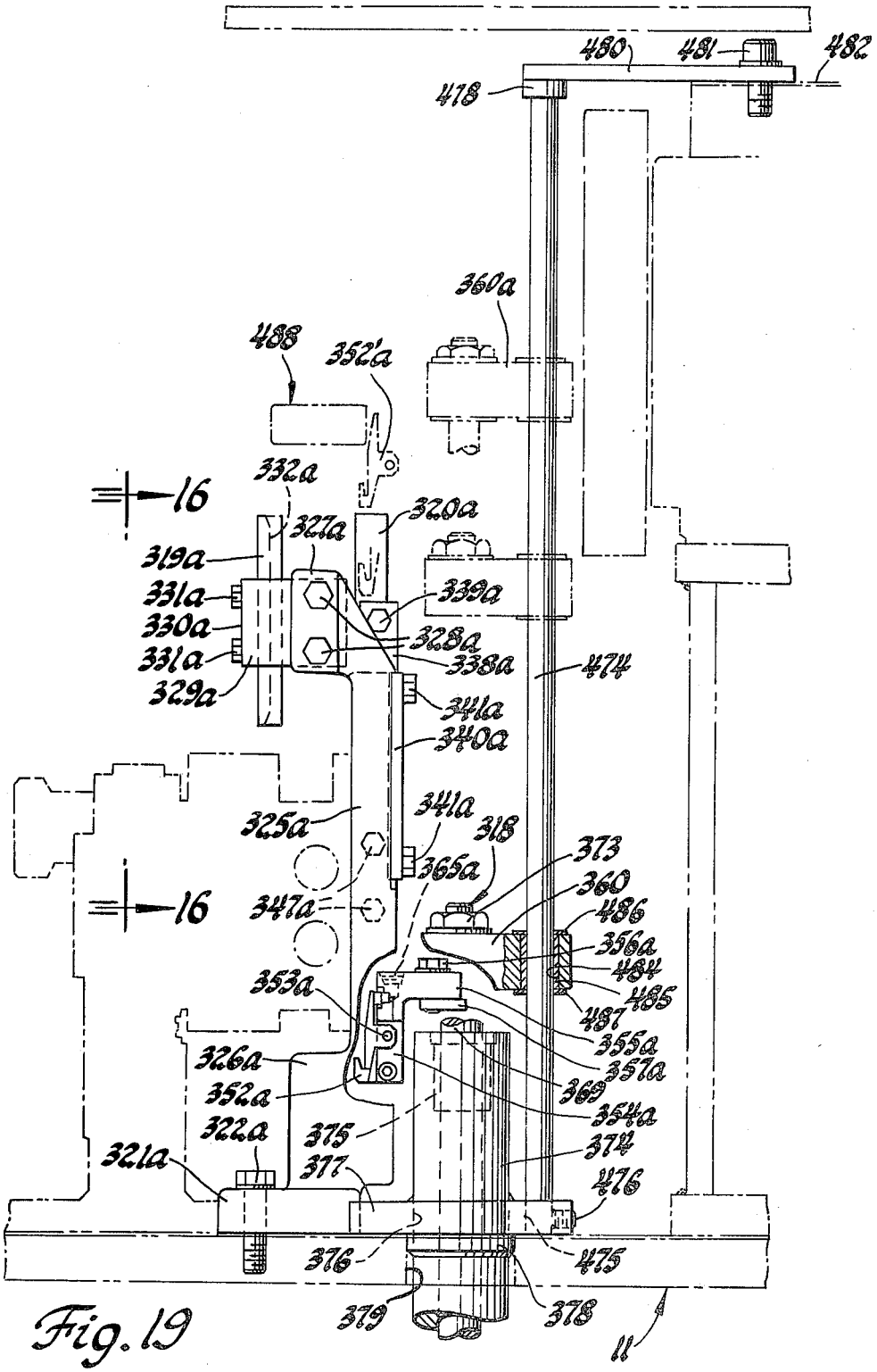
FIG. 19 is a fragmentary, elevation view, partly in section and with parts removed, of the carton loader structure illustrated in FIG. 14, taken along the line 19—19 thereof, and looking in the direction of the arrows.

As illustrated in FIG. 19, the guide members 319 and 320 are carried on a vertical support plate 325 which is integrally attached at its lower end to an offset vertical support plate 326 that is in turn fixed, as by welding, to a mounting plate 321. The vertical support plate 325 carries an integral, laterally offset bracket arm 327 which is adjustably secured by suitable machine screws 328 to one flange or arm 329 of an L-shaped carton guide bracket. The L-shaped carton guide bracket includes an integral second arm 330 (FIG. 14) which is disposed at right angles to the bracket arm 329 and secured by suitable machine screws 331 to the carton guide member 319.

Figure 16:
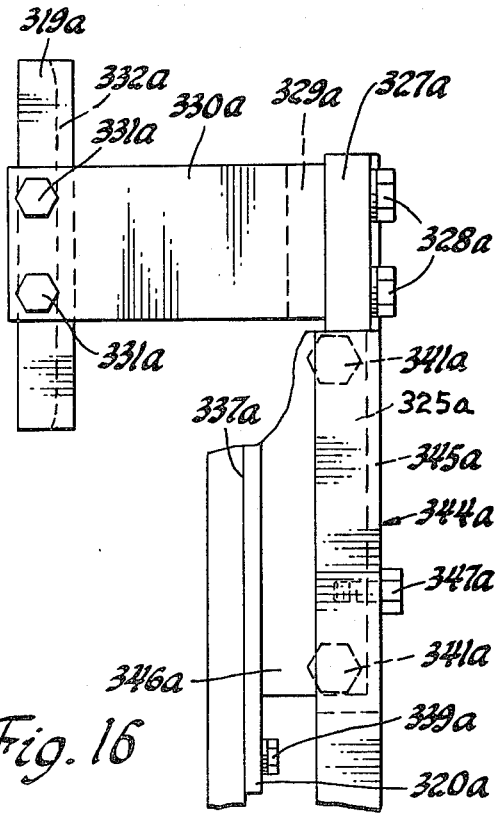
FIG. 16 is a fragmentary, elevational view of the carton loader structure illustrated in FIG. 19, taken along the line 16—16 thereof, and looking in the direction of the arrows.

As illustrated in FIGS. 14 and 16, each of the carton guide members 319 is provided with a longitudinally extended rectangular carton guide notch 332 on the inner face thereof for slidably receiving the rectangular corner of an expanded carton 9 for slidably guiding the carton 9 as it is moved upwardly by the hereinafter described loader structure. As seen in FIG. 16, the guide notch 332 is chamfered at the lower and upper ends thereof for easy entrance of the corner of a carton 9 in the notch 332. The numeral 337 (FIG. 14) designates a similar rectangular carton guide notch in the other diagonally disposed carton guide member 320. The guide notch 337 slidably guides a diagonally disposed corner on a carton 9 during a carton loading operation.

As illustrated in FIG. 14, the carton guide member 320 is secured by suitable machine screws 339 to a carton guide member mounting block 338. As illustrated in FIG. 14, the mounting block 338 is secured by any suitable means, as by welding, to a carton guide mounting plate 340. As illustrated in FIG. 19, the mounting plate 340 is secured by suitable machine screws 341 on the side of the vertical support plate 325. It will be seen from the foregoing that the carton guide members 319 and 320 may be adjusted to guide different size cartons by adjusting the various supporting structure for the guide members 319 and 320.

As shown in FIG. 14, a carton guide plate, generally indicated by the numeral 344, is also mounted on the vertical support plate 325. The carton guide plate 344 has a mounting plate portion 345 which is secured to the outer face of the vertical support plate 325 by suitable machine screws 347. The carton guide plate 344 also has an integral guide plate portion 346 which is angularly extended toward the guide member 320 and which is adapted to assist the expanding operation of the cartons 9 as they are withdrawn from the carton magazines 10 and 10*a* and moved to a fully erected position for sliding movement upwardly on the guide members 319 and 320.

As shown in FIG. 14, the carton loading means 318 includes a pair of carton loading hooks, indicated by the numerals 352 and 352*a*. The carton loading hooks 352 and 352*a* are disposed adjacent the positions of the expanded cartons 9. As indicated in FIG. 13, the initial position of each of the carton loading hooks 352 is shown as being below the lower edge of a carton 9 before the hook 352 is moved upwardly to engage the lower edge of a carton 9 for moving it upwardly and loading it onto a mandrel 488, as illustrated in FIG. 13. As shown in FIG. 14, the carton loading hooks 352 have a substantial width thereto for engaging a large portion of the lower edge of a carton 9 that it is lifting.

Figure 15:
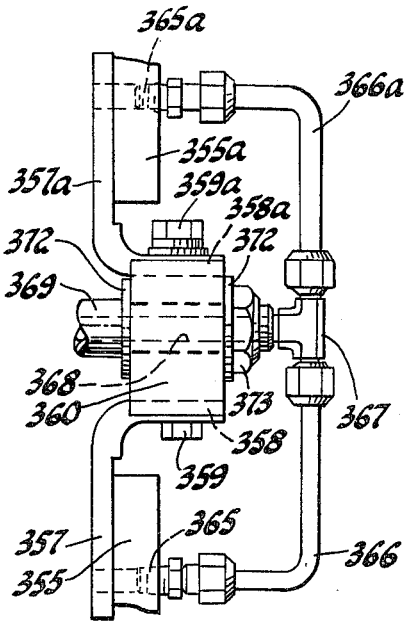
FIG. 15 is a fragmentary, elevational view of the carton loader structure illustrated in FIG. 14, taken along the line 15—15 thereof, and looking in the direction of the arrows, and turned 90°.

As illustrated in FIG. 19, each of the hooks 352 is pivotally mounted by a pivot pin 352 on the vertical leg 354 of an L-shaped loading hook mounting block which also has an integral horizontal leg 355 (FIG. 14) which is secured by suitable machine screws 356 to the horizontal flange 357 of an L-shaped mounting bracket. The last mentioned L-shaped mounting bracket has a vertical flange 358 (FIG. 15) which is secured by suitable machine screws 359 to a central mounting block 360. As shown in FIGS. 14 and 15, the mounting block 360 is centrally disposed between the two carton loading hooks 352 and it carries both of the hooks 352.

As shown in FIG. 19, the mounting block 360 is movable by the hereinafter described loading structure to be raised to the broken line position indicated by the numeral 360*a*, for moving the loading hooks 352 up to the position 352'*a*, at which position the two loading hooks have simultaneously moved two cartons 9 onto conventional mandrels 488 on a packaging machine for completing the forming, filling and closing of the cartons.

Figure 20:
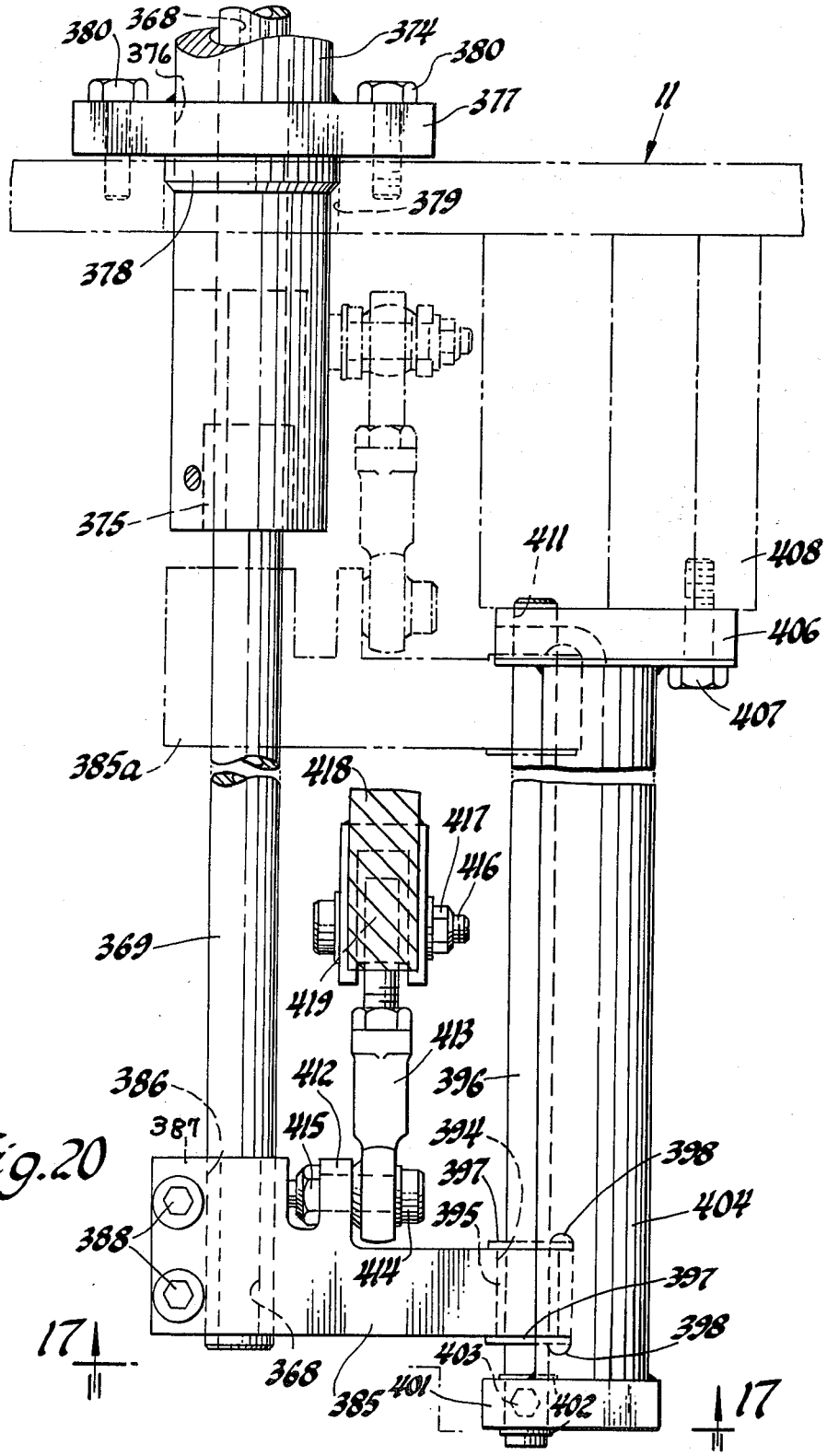
FIG. 20 is a fragmentary, enlarged, elevation view of the carton loader drive means structure illustrated in FIG. 21, taken along the line 20—20 thereof, looking in the direction of the arrows, and turned 90°.

As shown in FIGS. 15 and 19, each of the L-shaped blocks 355, which pivotally carry the loading hooks 352, are provided with suitable air passages 365, to the outer ends of which are connected one end of a suitable tubing 366 which has its other end operatively connected to a tee fitting 367. As shown in FIG. 15, the tee fitting 367 is operatively connected in the upper end of an air passageway 368 that is formed in the upper end of a lift rod 369. The lift rod 369 has its upper end mounted through a suitable bore in the block 360, and it is secured thereto by a pair of suitable washers and a lock nut 373. As shown in FIGS. 19 and 20, the lift rod 369 is slidably supported in a tubular guide shaft 374 which is operatively mounted through a bore 376 in a mounting plate 377. The lift rod 369 is slidably mounted in the guide shaft 374 by a pair of suitable upper and lower sleeve bushings 375. The shaft 374 is secured to the mounting plate 377 by any suitable means, as by welding. The mounting plate 377 is provided with an integral, downwardly extended hub 378, on the lower side thereof, which is seated in a bore 379 in the machine base plate 11. The mounting plate 377 is secured to the base plate 11 by suitable machine screws 380.

As shown in FIG. 20, the air passageway 268 extends completely through a lift rod 369, and the lower end thereof is connected to a suitable source of air under pressure for operating a carton jam detection means which is operatively mounted in each of the vertical legs 354 of each of the loading hook mounting block structures. Each of the loading hooks 352 is provided with a carton jam detection means, as disclosed in copending application, Ser. No. 731,174, filed Apr. 12, 1977, and owned by the assignee of the present application. The description of the carton jam detection means associated with each of the laoding hooks 352, as described in the said application, Ser. No. 731,174, L is incorporated herein by reference.

Figure 17:
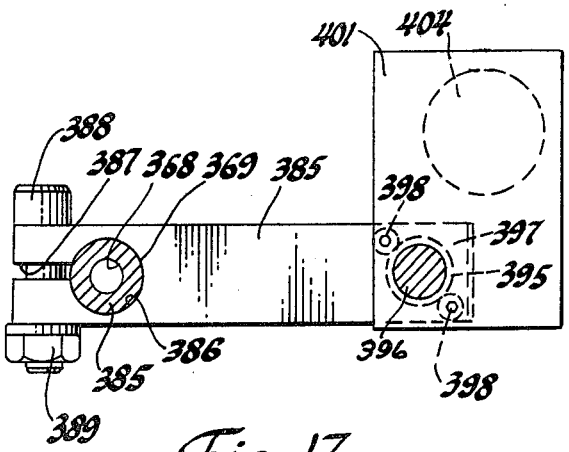
FIG. 17 is a fragmentary view of the carton loader drive means structure illustrated in FIG. 20, taken along the line 17—17 thereof, and looking in the direction of the arrows.

As shown in FIGS. 17 and 20, the lower end of the lift rod 369 is mounted through a bore 386 in one end of a transverse or horizontal lift rod bar 385. Said one end of the lift rod bar 385 is slotted from the bore 386 outwardly as shown by the numeral 387 in FIG. 17. The lift rod 369 is secured to the lift rod bar 385 by a pair of suitable machine screws 388, as shown in FIG. 20. As shown in FIG. 17, the machine screws 388 are secured in place by suitable lock nuts 389. As shown in FIG. 20, during a carton loading operation the lift rod bar 385 moves upwardly to the position indicated by the numeral 385*a*, at which time a carton loading operation is effected, and the lift rod bar 385 and the lift rod 369 are then lowered to the full line retracted initial position shown in FIG. 20.

As shown in FIG. 20, the lift rod bar 385 is provided at the other end with a vertical bore 394 in which is operatively mounted a bushing 395 for the sliding reception of a vertical guide rod 396. The bushing 395 is held in position in the lift rod bar 385 by a pair of suitable retainer plates 397 and a pair of machine screws 398. As shown in FIG. 20, the lower end of the guide rod 396 is mounted through a vertical bore in a horizontal mounting plate 401, and it is secured to the plate 401 by a suitable set screw 403 and a pair of retainer rings 402 (FIG. 20). As shown in FIG. 20, the mounting plate 401 is secured to the lower end of a vertically disposed, elongated guide rod support shaft 404 by any suitable means, as by welding. The upper end of the guide rod support shaft 404 is fixedly secured to the lower face of a mounting plate 406 by any suitable means, as by welding. The mounting plate 406 is secured by suitable machine screws 407 to a support structure 408 which is part of the packaging machine support structure with which the loader means 318 is operatively associated. The upper end of the guide rod 396 is threadably mounted in a suitable threaded bore 411 in the mounting plate 406.

Figure 21:
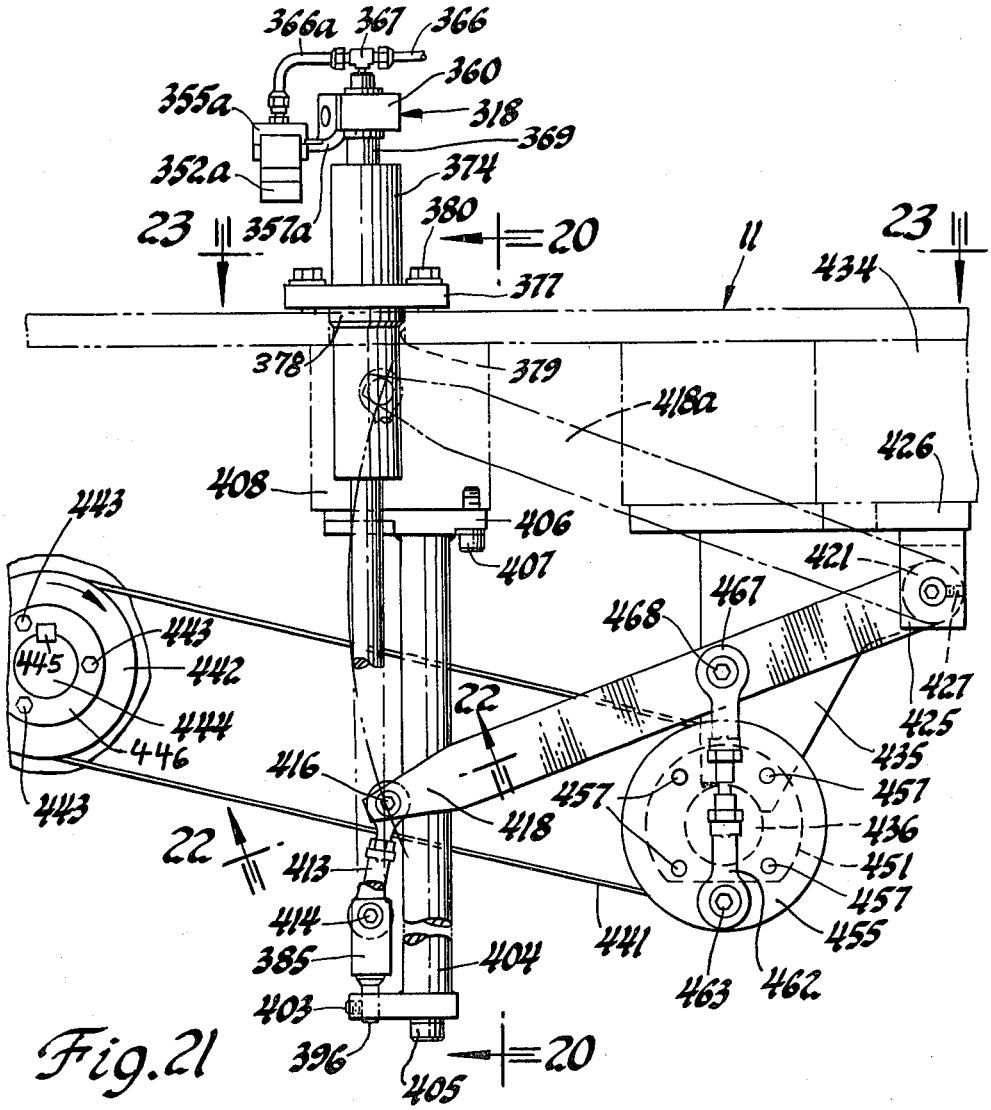
FIG. 21 is an elevation view of the carton loader structure illustrated in FIG. 14, with parts removed, taken along the line 21—21 thereof, and looking in the direction of the arrows.
Figure 22:
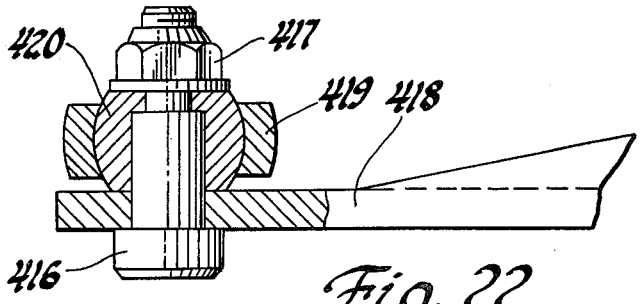
FIG. 22 is a fragmentary, enlarged elevational section view of the structure illustrated in FIG. 21, taken along the line 22—22 thereof, and looking in the direction of the arrows.

As shown in FIG. 20, the lift rod bar 385 is provided with an upwardly extended integral lug 412 to which is hingedly secured a connecting rod end member 413. The connecting rod end member 413 is connected to the lug 412 by a suitable machine screw shaft 414 and a lock nut 415. As shown in FIGS. 20 and 21, the upper end of the connecting rod is indicated by the rod end member 419 which is pivotally connected by a suitable machine screw shaft 416 to one end of a lift lever arm 418. The screw shaft 416 is locked in position by a suitable lock nut 417 (FIG. 20). As shown in FIG. 22, the connecting rod end member 419 is operatively mounted on the screw shaft 416 by a suitable ball shaped connector member 420.

Figure 24:
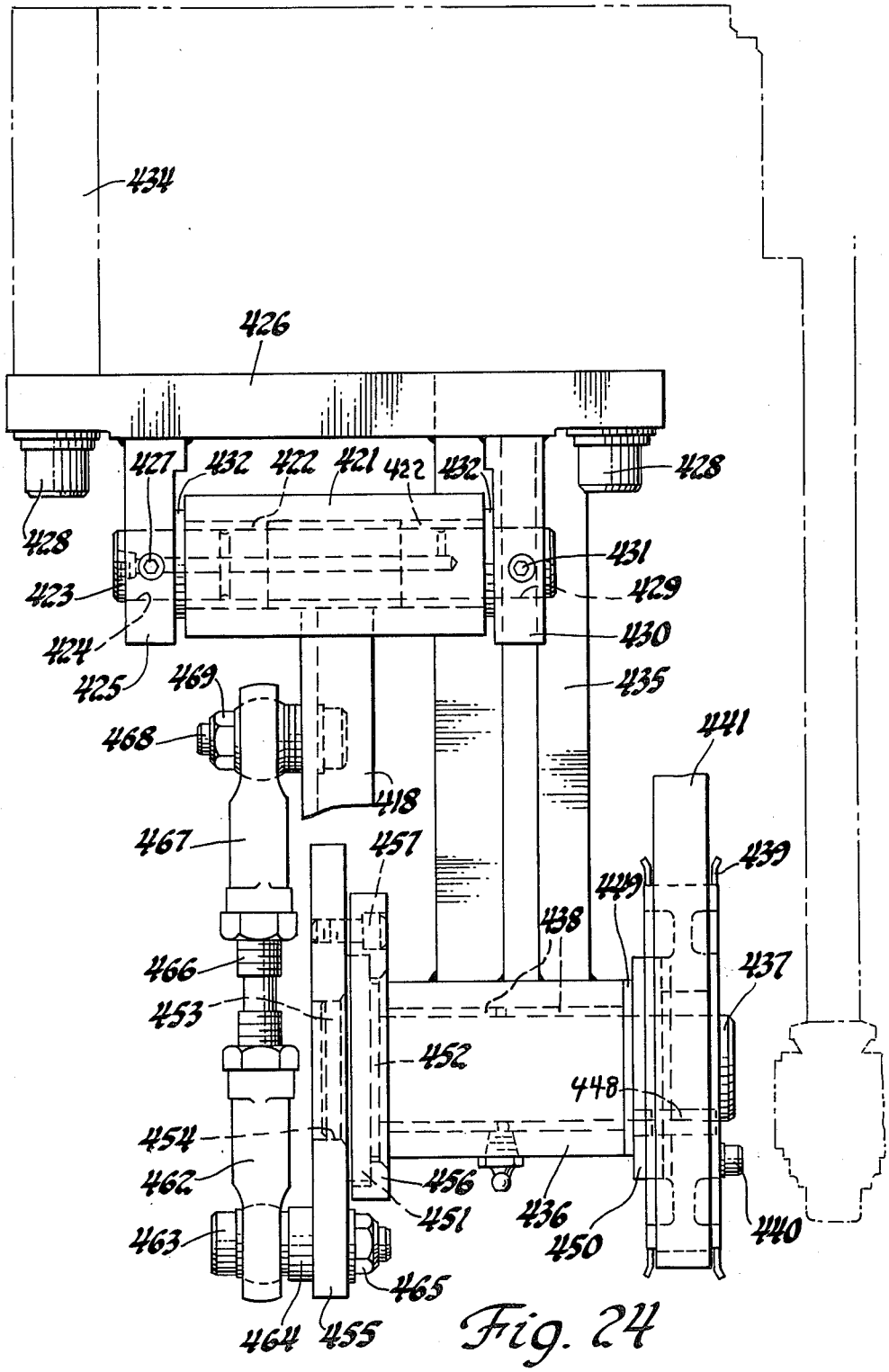
FIG. 24 is a fragmentary, elevational view of the carton loader drive means structure illustrated in FIG. 23, taken along the line 24—24 thereof, and looking in the direction of the arrows, and with parts removed.

As best seen in FIG. 21, the other end of the lift lever arm 418 is fixedly secured to the outer surface of a tubular mounting shaft or hub 421. As shown in FIG. 24, the tubular mounting shaft 421 is rotatably mounted by a pair of suitable bushings 422 on a pivot shaft 423. One end of the pivot shaft 423 is mounted through a horizontal bore 424 which is formed through a first vertically disposed bracket plate 425. The upper end of the bracket plate 425 is fixedly secured, as by welding, to the underside surface of a horizontally disposed mounting plate 426. The shaft 423 is fixed in the bore 424 in the bracket plate 425 by a suitable set screw 427. The mounting plate 426 is fixedly secured by suitable machine screws 428 to a suitable support structure 434 which comprises a part of the packaging machine with which the loader mechanism of the present invention is associated. The other end of the pivot shaft 423 is operatively mounted through a bore 429 in a second vertically disposed bracket plate 430. The bracket plate 430 is disposed parallel to the bracket plate 425 and its upper end is secured, as by welding, to the underside surface of the mounting plate 426 in a position laterally spaced apart from the bracket plate 425. The shaft 423 is fixed in the bore 429 in the bracket plate 430 by a suitable set screw 431. The tubular mounting shaft 421 is spaced apart from the bracket plates 425 and 430 by a pair of suitable thrust washers 432 which are disposed at the opposite ends of the shaft 421.

Figure 23:
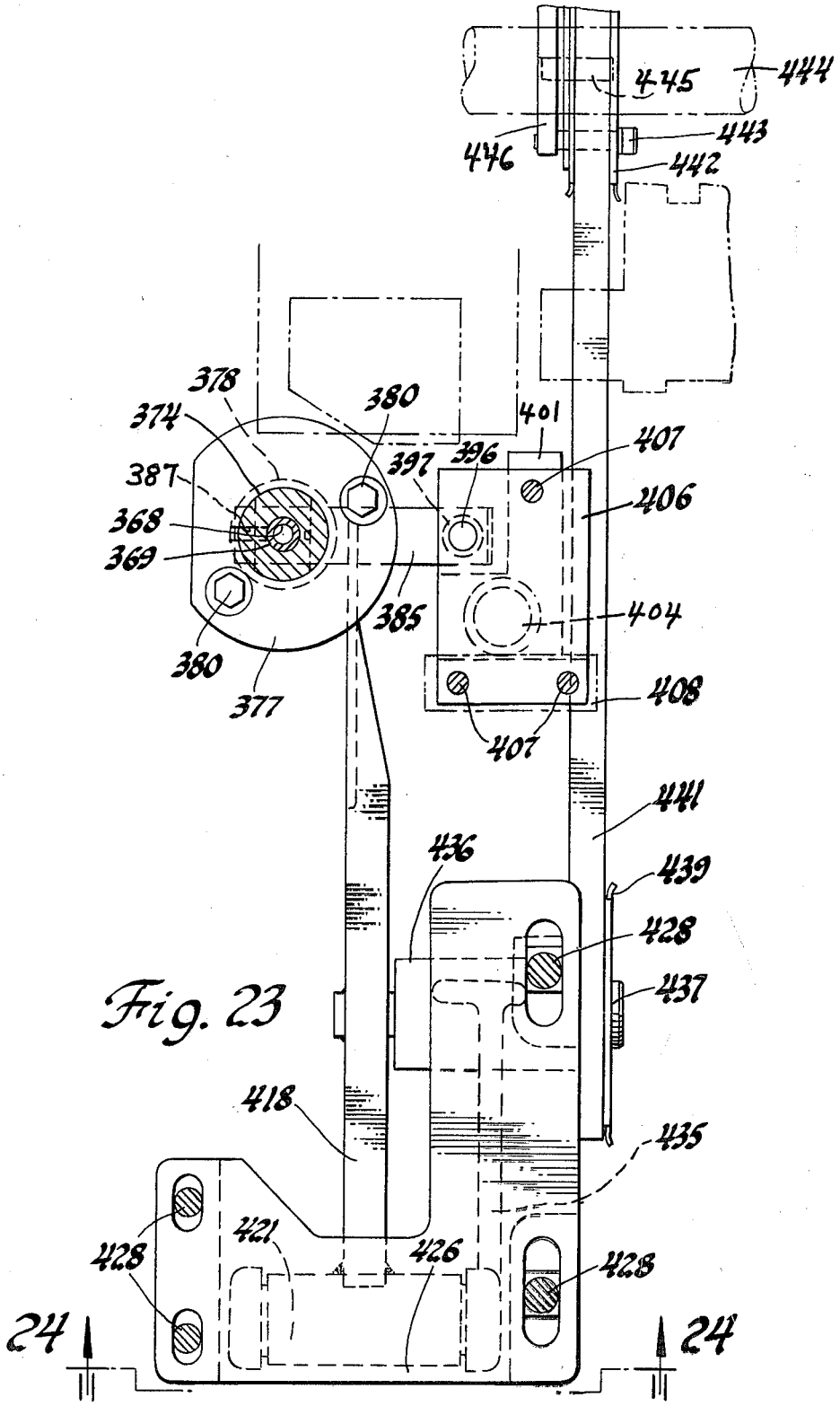
FIG. 23 is a top plan view of the carton loader drive means structure illustrated in FIG. 21, taken along the line 23—23 thereof, and looking in the direction of the arrows.

As shown in FIGS. 23 and 24, a bracket 435, having a T-shaped cross section, is secured, as by welding at its upper end, to the mounting plate 426. The lower end thereof is fixedly secured, as by welding, to a horizontally disposed hub or tubular mounting shaft 436. As shown in FIG. 24, a horizontally disposed idler shaft 437 is rotatably mounted in the hub 436 by means of a pair of laterally spaced apart bushings 438. As shown in FIGS. 23 and 24, a driven sprocket 439 is operatively mounted on one end of the idler shaft 437. As shown in FIG. 24, the driven sprocket 439 is seated on the shaft 437 and it is spaced from the adjacent end of the tubular mounting shaft 436 by an annular flange 450 and a suitable thrust washer 449. The driven sprocket 439 is secured to the flange 450 by suitable machine screws 440. The flange 450 and the driven sprocket 439 are drivably connected to the shaft 437 by a suitable key 448. As shown in FIGS. 21 and 23, the driven sprocket 439 is driven by a sprocket drive belt 441 which is operatively mounted around a driver sprocket 442. The driver sprocket 442 is operatively mounted about the drive shaft 444 of the packaging machine with which the loader mechanism of the present invention is associated. An annular flange 446 is also mounted about the machine main drive shaft 444. The driver sprocket 442 is secured to the annular flange 446 by a plurality of suitable machine screws 443. The drive sprocket 442 and the annular flange 446 are secured to the machine main drive shaft 444 by a suitable key 445.

As shown in FIG. 24, an annular flange 451 is integrally formed on the other end of the idler shaft 437. The flange 451 is spaced from the adjacent end of the tubular mounting shaft 436 by a suitable thrust washer 452. An attachment hub or ring 456 is operatively mounted around the annular flange 451, and it is secured to an annular drive disc 455 by a plurality of machine screws 457. The shaft 437 has an outwardly extended portion 453 which is received in a bore 454 in the annular drive disc for centering the same relative to the attachment hub 456.

As shown in FIGS. 21 and 24, a connecting rod end member 462 is pivotally attached by a suitable machine screw shaft 463 to the outer face of the drive disc 455. As shown in FIG. 24, the connecting rod end member 462 is spaced from the drive disc 455 by a spacer sleeve 464. The screw shaft 463 is held in its operative position by a suitable lock nut and washer means indicated by the numeral 465.

As shown in FIG. 24, a connector screw 466 connects the connecting rod end member 462 with an upper connecting rod end member 467 which is pivotally attached by a suitable machine screw shaft 468 to the lift lever arm 418 at an intermediate longitudinal position. As shown in FIG. 24, the screw shaft 468 is secured in its operative position by a suitable lock nut and washer means 469.

Figure 18:
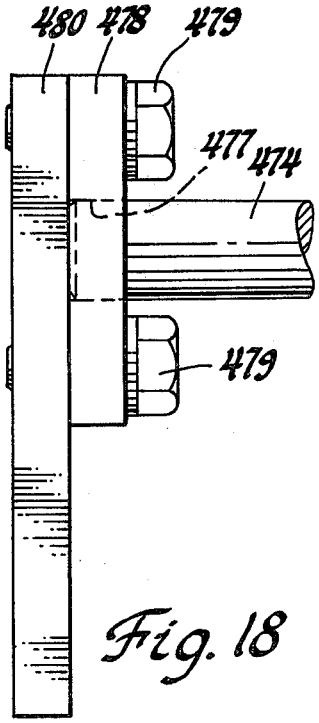
FIG. 18 is a fragmentary, elevational view of the carton loader structure illustrated in FIG. 14, taken along the line 18—18 thereof, and looking in the direction of the arrows.

As shown in FIGS. 14 and 19, the carton hook mounting block 360 is slidably engaged with a suitable vertical guide rod 474 to prevent rotation of the mounting block 360 as it is moved upwardly and downwardly. As shown in FIG. 19, the lower end of the guide rod 474 is operatively mounted in a bore 475 in the mounting plate 377, and it is secured in place by a suitable set screw 476. As illustrated in FIG. 18, the upper end of the guide rod 474 is seated in a suitable bore 477 in the horizontal guide rod plate 478. The guide rod plate 478 is secured by suitable machine screws 479 to the lower side of a horizontally disposed guide rod mounting plate 480. As shown in FIGS. 14 and 19, the guide rod mounting plate 480 is fixedly secured by suitable machine screws 481 to the packaging machine support structure 482 which forms part of the packaging machine with which the loader mechanism of the present invention is associated.

The mounting block 360 is slidably mounted on the guide rod 474 by means of a bushing 485 (FIG. 19) which is mounted in a vertical bore 484 formed in the rear end of the mounting block 360. The bushing 485 is retained in the bore 484 by a pair of suitable upper and lower retainer plates 486 and 487, respectively.

In operation, a plurality of flattened tubular carton or container blanks 9 are loaded into the magazines 10 and 10*a*. The cartons may be of the gable or flat top type as shown in U.S. Pat. Nos. 3,120,333; 3,185,375; 3,185,376; 3,270,940; 3,294,310; and 3,406,892. In loading the flattened cartons 9 into the magazines 10 and 10*a*, the carton pusher means 58 and 58*a* are moved rearwardly to the positions 58' and 58'*a*, as shown in FIG. 1, where they are held in that position by the safety latch 115. The flattened cartons 9 are then loaded into the magazine 10 and they rest on the carton slide rails 30 and 32, and between the carton guide rails 35 and 36 on one side, and guide rails 37 on the other side. The magazine 10*a* is loaded in the same manner. After a plurality of the flattened cartons 9 have been loaded into the respective magazines 10 and 10*a*, the respective latches 115 and 115*a* are released to permit the weights 81, as illustrated in FIG. 1, to exert a tension on the cables 83 and move the carton pusher means 58 and 58*a* to the right, as viewed in FIG. 1, to move the frontmost flattened carton 9 into the position shown in FIG. 2A against the side retainer fingers 139 and 141, and the vertical lip on the bottom retainer strap 146, and the top retainer rod 172.

The packaging machine controls are then operated to commence the carton feeding operation by the oscillating carton feeder means 177 and 177*a*, which operate simultaneously to withdraw a single flattened carton blank 9 from each of the magazines 10 and 10*a*, respectively, and rotate the withdrawn cartons from the frontmost positions in the magazines 10 and 10*a* to positions where the cartons are erected or squared to a generally rectangular position, as shown in FIG. 7, for the next step of loading the expanded carton blanks onto a pair of mandrels on a forming, filling and closing indexing turret of the packaging machine.

The carton feeder mechanisms 177 and 177*a* are illustrated as being adapted to withdraw small size cartons having a 2¼" square cross section and which may have a capacity of four, six, eight or ten ounces. As illustrated in FIG. 8, the carton feeder mechanisms 177 and 177*a* comprise a swinging arm structure which is provided with two vacuum cups 229. The vacuum cups 229 are conventional vacuum cups and they are primarily of the character described in U.S. Pat. No. 2,357,535. It will be understood that the aforedescribed passageways 230, 231 and 232 for feeding an operative vacuum to the vacuum cups 229 would be connected to a suitable source of vacuum, and the controls for the vacuum may be of any suitable type since they do not form any part of the present invention.

The swinging arm structure of each of the oscillating carton feeder mechanisms 177 and 177*a* is provided with bowing flanges 212 and 215, and a guide angle bar 220. When the swinging arm structures of the carton feeding mechanisms 177 and 177*a* commence their counterclockwise movement, as viewed in FIG. 7, from their initial starting positions indicated by the broken line position in FIG. 7, the vacuum cups 229 and 229*a* engage one panel of the four panels of a respective flattened carton blank 9, and when a pair of cartons 9 are withdrawn from their respective magazines 10 and 10*a*, the cartons pop open as shown by the progressive carton opening sequence shown in broken lines adjacent the carton feeder mechanism 177*a*. As the rotation of the carton feeder arm structures continue, each of the respective cartons 9 are moved past an erecting or squaring guide plate, as 344 and 344*a*, and thence into a final squared position as shown in FIG. 7. The vacuum cups 229 and 229 and 229*a* exert a rearward pressure on said one carton panel and holds that particular carton panel against the bowing flanges 212 and 215, and along the outer face of the angle bar 220. The angle bars 220 and 220*a* function to guide each of the respective cartons 9, as they are rotated, into the fully squared positions shown in FIG. 7. FIG. 13 illustrates a modified elongated carton feeder arm structure which is provided with four vacuum cups indicated by the numerals 229*b*. The swinging feeder arm structure of FIG. 13 is adapted to be used for larger capacity containers or cartons having the same 2¼" square cross section but which are longer than the cartons handled by the feeder structure of FIG. 8.

When a pair of cartons 9 have been squared, and with a pair of conventional carton bottom end forming mandrels 488 (FIGS. 13 and 19) in position above the squared cartons 9 for receiving the cartons, the carton loader means 318 is operated so as to engage the lower ends of the two squared cartons 9 and move them upwardly onto their respective mandrels 488. As illustrated in FIG. 14, the carton loader means 318 includes the two wide hook members 352 and 352*a* and they engage the lower end of one of the panels of each of the squared cartons 9 and move them upwardly through each respective pair of carton guide members 319 and 320 which function to maintain the squareness of the cartons 9 as they are moved upwardly by the hooks 352 and 352*a*. The carton loader hooks 352 and 352*a* are carried on the upper end of the lift rod 369 which is operated upwardly and downwardly so as to raise the hooks from the lower position 352 shown in FIG. 13, up to the position indicated by the numeral 352'*a*, at which point a carton 9 has been assembled onto its respective mandrel 488 by sliding the same upwardly from the bottom end thereof. The guide rod 474 as shown in FIG. 19, guides the carton hooks 352 and 352*a* during the movement between the retracted or lower position and the raised position 352'*a*, and the movement back into the retracted position.

The power drive means for operating the carton feeder means 177 and 177*a*, and the power drive means for operating the carton loader means 318 are both driven from the packaging machine shaft 444 which is driven by any suitable power drive means, as for example, an electric drive motor. The barrel cam 311 in FIG. 12 controls the swinging motion of the carton feeders 177 and 177*a* as previously described. The carton loader means 318 is operated by the power drive means illustrated in FIGS. 21, 22 and 24 which is driven by the packaging machine shaft 444. As shown in FIG. 21, the lift rod 369 is actuated upwardly and downwardly by the lift lever arm 418, which is actuated upwardly and downwardly when the drive disc 455 is rotated through the action of the packaging machine shaft 444 driving the drive belt 441 which turns the driven sprocket 439 and the flange 451 (FIG. 25), which in turn drives the drive disc 455, whereby the connecting rod comprising the rod end members 462 and 467 move the lift lever arm 418 upwardly and downwardly to move the lift rod 369 upwardly and downwardly.

It will be understood that the operator's controls for the carton feeder means 177 and 177*a* and the carton loader means 318 will be incorporated into the overall operator's control means for the packaging machine with which the apparatus of the present invention is associated. Any suitable control circuit means may be employed for controlling the operations of the carton feeder means 177 and 177*a* and the carton loader means 318 since the control circuit means does not form any part of the present invention.

The carton magazines 10 and 10*a* of the present invention comprise universal carton blank magazines since they can be adjusted for feeding cartons from either the right or left hand side, or they can be loaded from either the right or left hand side. The parts of the magazines 10 and 10*a* are constructed and arranged so that they can be assembled symetrically opposite, for either loading or for feeding. For example, as viewed in FIG. 4, the top carton guide rail 35 can be changed from its left hand position to the right hand position in the opening 48 in the guide plate 41. In such a change, the short front guide rail 38 as shown in FIG. 1, would then be changed to the opposite side to the position marked by the numeral 38'. The cartons 10 and 10*a* can be disposed in a position relative to the packaging machine with which they are working so that they are not too far from the ground, so as to permit quick and easy loading of the carton blanks into the magazines. For example, in one of the embodiments, said magazines were disposed about 33" from the floor from which the packaging machine was positioned, and in a machine processing a larger carton the magazines were situated at an elevation of about 36" above the floor.

The carton magazine apparatus, carton feeder apparatus and carton loader apparatus of the present invention are especially adapted for use with an indexing packaging machine which indexes a pair of cartons through a carton forming, filling and closing path.

INDUSTRIAL APPLICABILITY

The carton magazine, feeder and loader apparatus of the present invention is adapted for use with packaging machines which package liquid products, granular products, and similar products capable of being loaded into a gable or flat top type carton or container from a flow type filler apparatus, as for example, various dairy products, soft drinks, flowable solid food products, and liquid type products such as oils and the like.

We claim:

1. A carton feeder apparatus for use in a packaging machine for forming, filling and closing cartons, characterized in that the carton feeder apparatus includes:

(a) a pivot shaft rotatably mounted on the support structure of the packaging machine;

(b) a carrier member fixedly secured to the pivot shaft;

(c) vacuum cup means operatively mounted on said carrier member and adapted to engage one outer panel of each frontmost carton withdrawn from a carton magazine when brought into contact therewith;

(e) means connected to said gear drive means for operating the gear drive means so as to rotate said pivot shaft;

(f) a pair of vertically spaced apart arm members having one end freely rotatable on the carton feeder arm pivot shaft; and (g) means attached to the feeder arm members and adapted to engage said one outer panel during the rotation of said pivot shaft to assist in the expansion and erection of the carton into an erected tubular carton;

2. The carton feeder apparatus described in claim 1, and means attaching said feeder arm members to said carrier member to allow relative movement between the bowing flanges and the vacuum cup means when a carton is withdrawn from the carton magazine during a carton expansion and erection action.

3. The carton feeder apparatus described in claim 1, and guide angle bar means secured to said feeder arm members for guiding each of said cartons into a final squared position.

4. The carton feeder apparatus described in claim 1, and guide plate means fixedly secured intermediate said carton magazine and a final carton opening position for engaging a second outer panel of the carton as it moves therepast to assist in the opening process.

5. The carton feeder apparatus described in claim 1, wherein said bowing flange means includes a carton engaging flange mounted on the end of said arm members.

6. The carton feeder apparatus described in claim 1, wherein said bowing flange means includes a bowing channel mounted on an intermediate portion of each of said arm members.

7. The carton feeder apparatus described in claim 1, wherein said vacuum cup means is mounted intermediate said bowing flange means.

8. The carton feeder structure as defined in claim 1, characterized in that said means connected to said gear drive means for operating the gear drive means includes:

(a) a cam means operatively connected to the drive means of the packaging machine; and (b) lever means operated by said cam means for operating the gear drive means.

9. The carton feeder structure as defined in claim 2, characterized in that:

(a) said means for attaching arm members to the carrier member to allow said relative movement between the bowing flanges and the vacuum cup means comprises a spring means which normally maintains the bowing flanges in a first position relative to the vacuum cup means but which permits said relative movement when a carton is withdrawn from a carton magazine.

* * * * *

UNITED STATES PATENT OFFICE

CERTIFICATE OF CORRECTION

Patent No. 4,244,281 Dated January 13, 1981

Inventor(s) Ivan L. Kauffman, Robert J. Allen, Gregory J. Dwyer

It is certified that error appears in the above-identified patent and that said Letters Patent are hereby corrected as shown below:

Claim 1, Column 23, between lines 30 and 31 insert --(d) gear drive means operatively connected to the pivot shaft;--

Claim 1, Column 23, line 37, between (g) and means, insert --bowing flange--

Signed and Sealed this

First Day of May 1984

[SEAL]

*Attest:*

GERALD J. MOSSINGHOFF

*Attesting Officer*

*Commissioner of Patents and Trademarks*